US010109447B1

(12) United States Patent
Hoff et al.

(10) Patent No.: US 10,109,447 B1
(45) Date of Patent: Oct. 23, 2018

(54) ELECTRON BEAM MODULATOR BASED ON A NONLINEAR TRANSMISSION LINE

(71) Applicant: The United States of America, as represented by the Secretary of the Air Force, Washington, DC (US)

(72) Inventors: Brad W. Hoff, Albuquerque, NM (US); David H. Simon, Albuquerque, NM (US); James A. Schrock, Albuquerque, NM (US)

(73) Assignee: The United States of America as Represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 15/994,365

(22) Filed: May 31, 2018

(51) Int. Cl.
*H01J 7/46* (2006.01)
*H01J 7/44* (2006.01)
*H01J 23/15* (2006.01)
*H01J 23/04* (2006.01)

(52) U.S. Cl.
CPC ..... *H01J 7/44* (2013.01); *H01J 23/04* (2013.01); *H01J 23/15* (2013.01); *H01J 2223/54* (2013.01)

(58) Field of Classification Search
CPC .... H01J 7/44; H01J 23/04; H01J 23/25; H01J 2223/54
USPC ..... 315/39
See application file for complete search history.

(56) References Cited

U.S. PATENT DOCUMENTS 6,239,637 B1 * 5/2001 Williamson ..... H03K 5/12 327/134
6,396,338 B1 * 5/2002 Huang ..... H03D 3/06 329/303
7,170,444 B1 1/2007 Seddon et al.
7,532,083 B2 * 5/2009 Hannah ..... H01P 3/003 333/20
7,573,157 B1 8/2009 Clark
7,612,629 B2 * 11/2009 Pepper ..... H03B 19/05 327/106
8,766,541 B1 7/2014 Hoff et al.
9,685,296 B1 * 6/2017 Hoff ..... H01J 29/52
(Continued)

OTHER PUBLICATIONS

Hoff, B., et al., "Simulations of a Disk-on-Rod TWT Driven by an NLTL-Modulated Electron Beam," IEEE Transactions on Plasma Science, vol. 44, No. 8, Aug. 2016, pp. 1265-1269.
(Continued)

*Primary Examiner* — Don Le
(74) *Attorney, Agent, or Firm* — James M. Skorich

(57) ABSTRACT

An apparatus, system, and method for performing electron beam modulation includes an input pulser to provide an electromagnetic pulse; a radio frequency (RF) filter to filter the electromagnetic pulse; a nonlinear transmission line to receive the electromagnetic pulse, and generate a backward wave RF oscillation of a predetermined frequency to travel in a direction opposite that of the electromagnetic pulse; and an electron beam generating device including an anode and a cathode, the electron beam generating device to receive a combined electromagnetic pulse from the RF filter and the backward wave RF oscillation from the nonlinear transmission line to cause excitation of a modulated voltage between the anode and cathode, and to cause the electron beam generating device to emit an electron beam that is modulated at the predetermined frequency of the backward wave RF oscillation.

20 Claims, 23 Drawing Sheets

(56) References Cited

U.S. PATENT DOCUMENTS

| | | | | |
|---|---|---|---|---|
| 2001/0011930 | A1* | 8/2001 | Kintis | H03K 5/12 333/20 |
| 2007/0159760 | A1 | 7/2007 | Clark | |
| 2008/0254759 | A1* | 10/2008 | Kintis | H03D 7/1408 455/326 |
| 2015/0326257 | A1* | 11/2015 | Xi | H03D 7/1491 455/90.2 |

OTHER PUBLICATIONS

French, D., et al., "Nonlinear transmission line based electron beam driver," Review of Scientific Instruments, vol. 83, Dec. 19, 2012, pp. 123302-1 through 123302-4.
Bragg, J., et al., "Material selection considerations for coaxial, ferrimagnetic-based nonlinear transmission lines," Journal of Applied Physics, vol. 113, Feb. 12, 2013, pp. 064904-1 through 064904-4.
Johnson, J., et al., "Characteristics of a four element gyromagnetic nonlinear transmission line array high power microwave source," Review of Scientific Instruments, vol. 87, May 4, 2016, pp. 054704-1 through 054704-7.
French, D., et al., "Dielectric Nonlinear Transmission Line," 2011 IEEE Pulsed Power Conference (PPC), Jun. 19-23, 2011, Chicago, Illinois, Published by IEEE, 5 pages.
Branch, G., "Shock Waves in Transmission Lines with Nonlinear Dielectrics," IEE Colloquium on Pulsed Power '933, Feb. 17, 1993, London, United Kingdom, 3 pages.
Ikezi, H., et al., "High-power soliton generation at microwave frequencies," J. Appl. Phys. vol. 64, No. 6, Sep. 15, 1988, pp. 3277-2181.
Neto, L., et al., "Characterization of Ceramic Dielectrics for Sub-GHz Applications in Nonlinear Transmission Lines," IEEE Transactions on Plasma Science, vol. 42, No. 10, Oct. 2014, pp. 3274-3282.
Neto, L., et al., "High-Power RF Generation From Nonlinear Transmission Lines With Barium Titanate Ceramic Capacitors," IEEE Transactions on Plasma Science, vol. 44, No. 12, Dec. 2016, pp. 3424-3431.
Gevorgian, S., et al., "Tuneable Film Bulk Acoustic Wave Resonators, Engineering Materials and Processes: Chapter 2—Dielectric, Mechanical, and Electromechanical Properties of Ferroelectrics and Piezoelectrics," Springer-Verlag, London, United Kingdom, 2013, pp. 17-54.
Afshari, E., et al., "Nonlinear Transmission Lines for Pulse Shaping in Silicon," IEEE Journal of Solid-State Circuits, vol. 40, No. 3, Mar. 2005, pp. 744-752.
Coleman, P., et al., "Characterization of a Synchronous Wave Nonlinear Transmission Line," 2011 IEEE Pulsed Power Conference (PPC), Jun. 19-23, 2011, Chicago, Illinois, 5 pages.
Johnson, J., et al., "Material selection of a ferrimagnetic loaded coaxial delay line for phasing gyromagnetic nonlinear transmission lines," Review of Scientific Instruments, vol. 86, Aug. 5, 2015, pp. 084702-1 through 084702-5.
French, D., et al., "Spatially Dispersive Ferrite Nonlinear Transmission Line With Axial Bias," IEEE Transactions on Plasma Science, vol. 42, No. 10, Oct. 2014, pp. 3387-3390.
Belyantsev, A., et al., "Generation of RF Oscillations in the Interaction of an Electromagnetic Shock with a Synchronous Backward Wave," Technical Physics, vol. 45, No. 6, Jun. 2000, pp. 747-752.
Belyantsev, A., et al., "RF Oscillation Generated by an Electromagnetic Shock Wave in Coupled Transmission Lines with Anomalous and Normal Dispersion," Technical Physics, vol. 46, No. 7, Jul. 2001, pp. 864-867.
Seddon, N., et al., "Observation of the Inverse Doppler Effect," Science, vol. 302, Nov. 28, 2003, pp. 1537-1540.
Zola, J., "Simple Model of Metal Oxide Varistor for Pspice Simulation," IEEE Transactions on Computer-Aided Design of Integrated Circuits and Systems, vol. 23, No. 10, Oct. 2004, pp. 1491-1494.
Golden, F., "A New Component—The Metal Oxide Varistor Suppressor," 1972 IEEE Power Electronics Specialists Conference, May 22-23, 1972, Atlantic City, New Jersey, pp. 134-139.
Matsushima, T., et al., "Equivalent Circuit Model with Nonlinear Characteristics of Zener Diode Extracted from SPICE Model for ESD Simulation," 2017 11th International Workshop on the Electromagnetic Compatibility of Integrated Circuits (EMCCompo), Jul. 4-8, 2017, St. Petersburg, Russia, pp. 152-155.

* cited by examiner

ω/k
$u_{s1}$
$u_{s2}$
81
82
83
ω [Normalized]
1.0
0.8
0.6
0.4
0.2
0.0
0.0
0.5
1.0
1.5
2.0
kd [π]

dω/dk
84
dω/dk [Normalized]
1.0
0.5
0.0
-0.5
-1.0
0.0
0.5
1.0
1.5
2.0
kd [π]

89
87
88
86
25e
$u_s$
$-u_b$

ELECTRON BEAM MODULATOR BASED ON A NONLINEAR TRANSMISSION LINE

GOVERNMENT INTEREST

The invention described herein may be manufactured and used by or for the Government of the United States for all government purposes without the payment of any royalty.

BACKGROUND

Field of the Invention

The embodiments herein generally relate to high power microwave technologies, and more particularly to nonlinear transmission line modulated beam drivers used for high power microwave devices.

Background of the Invention

In applications involving generation of high power microwaves using energetic electron beams, it is often advantageous to generate a modulated electron beam directly from the cathode of the device. For properly designed microwave devices, injection of a modulated beam allows for much faster startup of radio frequency (RF) oscillations when compared to the slower process of allowing a device to slowly develop modulations on a uniform beam through amplification of noise or a comparatively smaller injected RF wave. As described in U.S. Pat. Nos. 8,766,541 and 9,685,296, the complete disclosures of which, in their entireties, are herein incorporated by reference, one advantageous way to generate a modulated electron beam directly from the cathode of an electron beam generating device is through the application of a nonlinear transmission line (NLTL) beam modulator.

While NLTL-modulated beam drivers have been demonstrated in a number of configurations, these configurations all share a defining property: they are forward wave devices. This means that within the NLTL, the injected electromagnetic drive pulse travels the same direction through the line as the generated RF oscillatory wave.

The illustrations provided in FIGS. 1A through 1C depict a RF generation process occurring within a NLTL operating in a forward wave mode. For the purposes of these illustrations, losses within the NLTL are neglected. Additionally, the RF and input current pulse contributions, which are associated with RF and input pulse voltages, are shown separately. It is assumed that the measured current at any point along the NLTL would show a superposition of the input pulse current and the oscillatory RF current. Also, the dotted vertical line 1 in FIGS. 1A through 1C represents a fixed position along the length of the NLTL, for reference.

The shock front 3, which is formed at the leading edge of the input current pulse 4, propagates down the length of the NLTL at velocity $u_s$ and RF oscillations 5 are generated. The shock velocity, $u_s$, represents the fastest possible propagation speed down the unsaturated NLTL. The RF propagations speed (i.e., group velocity) will typically be slower by some differential velocity value $\Delta u_f$. This means that the propagation speed of the RF wave is $u_s-\Delta u_f$. As the RF oscillations travel at a slightly slower speed than the shock, they fall behind as additional oscillations are continuously generated by the shock, as shown in FIG. 1B. In this manner, the train of RF oscillations 5 gradually extends behind the shock front 3 but continues to travel in the same direction down the line as the shock, as shown in FIG. 1C.

With reference to FIG. 2, as the electromagnetic shock front, represented as the sharp transition 66 in curve 67, where curve 67 represents the current along the NLTL 25*d*, propagates at velocity $u_s$ 69 and travels through a given stage 71 in the NLTL 25*d*, the nonlinear inductor 62*d*, typically a ferrite, is driven fully into saturation. Fully saturated inductors 63 no longer exhibit significant nonlinearity. Thus, the region 68 of NLTL 25*d* behind the shock front 66 behaves as a linear dispersive transmission line comprised of capacitors 60*d* (C) and saturated inductors 63 ($L_{sat}$). Dotted line 2 is included as a representation of a fixed point along the length of the NLTL 25*d*, which, in FIG. 2, is located between stages n+1 and n+2. It is noted that while line current (e.g., curve 67) and shock front (current) 66 are explicitly represented in FIG. 2, there exist analogous line and shock front voltages, which are implied in FIG. 2, but not explicitly depicted for clarity of illustration.

FIG. 3A depicts a NLTL beam modulator in which the input pulser 6 is electromagnetically connected to the NLTL 7 which is, in turn, connected to the electron beam generating device 8. As depicted by path 9*a* in FIG. 3B, the drive current pulse transits from the input pulser 6, through the NLTL 7, to the cathode of the electron beam generating device 8. The oscillatory RF wave generated within the NLTL 7 transits from the NLTL 7 to the cathode of the electron beam generating device 8, as shown by path 9*b*. Because both the input pulse and the RF oscillations transit the same direction to the cathode of the electron beam generating device, the depicted NLTL beam modulator is inherently a forward wave device.

BRIEF SUMMARY OF THE INVENTION

In view of the foregoing, an embodiment herein provides an apparatus for performing electron beam modulation, the apparatus comprising an input pulser to provide an electromagnetic pulse; a radio frequency (RF) filter to filter the electromagnetic pulse by isolating the input pulser from high frequency electromagnetics; a NLTL to receive the electromagnetic pulse, and generate a backward wave RF oscillation of a predetermined frequency to travel in a direction opposite that of the electromagnetic pulse; and an electron beam generating device comprising an anode and a cathode, the electron beam generating device to receive a combined electromagnetic pulse from the RF filter and the backward wave RF oscillation from the NLTL to cause excitation of a modulated voltage between the anode and cathode, and to cause the electron beam generating device to emit an electron beam that is modulated at the predetermined frequency of the backward wave RF oscillation. The NLTL may comprise any of a capacitor, inductor, and resistor, one or more of which have a nonlinear electromagnetic response. Any of the anode and the cathode may receive the combined electromagnetic pulse and the backward wave RF oscillation. The RF filter may block the backward wave RF oscillation from interacting with a portion of the input pulser. The input pulser may contain the RF filter. Any of the anode and cathode may emit the modulated electron beam. The apparatus may comprise a termination component to ground the electromagnetic pulse transmitted from the NLTL.

Another embodiment comprises a system comprising an input pulser to generate an electromagnetic pulse to travel in a first direction; a filter to control the electromagnetic pulse; a NLTL to interact with the electromagnetic pulse to form a shock front, and generate a backward wave RF oscillation to travel in a second direction opposite that of the first direction; a termination component to ground the electromagnetic pulse transmitted from the NLTL; and a device to receive the electromagnetic pulse from the filter and the backward wave RF oscillation from the NLTL. The device may comprise an electron beam generating device to emit an electron beam that is modulated at a frequency of the backward wave RF oscillation. The electron beam generating device may comprise an anode and a cathode. A polarity of the electromagnetic pulse may determine whether the electromagnetic pulse enters the electron beam generating device through either the anode or cathode. The device may comprise an antenna. The system may comprise a high pass filter between the NLTL and the antenna. The termination component may comprise any of a metal oxide varistor and a Zener diode, or an electromagnetically equivalent component, in series with a termination load of the NLTL. The metal oxide varistor or electromagnetically equivalent component may be set to conduct at a voltage level of approximately a peak value of the input pulser.

Another embodiment provides a method comprising directing an electromagnetic pulse to travel in a first direction; interacting the electromagnetic pulse with a NLTL to create a shock front; generating a backward microwave oscillation of a predetermined frequency to travel in a second direction opposite that of the first direction of the electromagnetic pulse; and combining the electromagnetic pulse and the backward microwave oscillation from the NLTL. The method may comprise transmitting the electromagnetic pulse from the NLTL; and grounding the electromagnetic pulse transmitted from the NLTL. The method may comprise emitting an electron beam from the combined electromagnetic pulse and the backward microwave oscillation. The method may comprise modulating the electron beam at the predetermined frequency of the backward microwave oscillation. The method may comprise driving current to an antenna with the backward microwave oscillation. The method may comprise setting an amplitude of the electromagnetic pulse to be consistent.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION OF THE INVENTION

Embodiments of the disclosed invention, its various features and the advantageous details thereof, are explained more fully with reference to the non-limiting embodiments that are illustrated in the accompanying drawings and detailed in the following description. Descriptions of well-known components and processing techniques are omitted to not unnecessarily obscure what is being disclosed. Examples may be provided and when so provided are intended merely to facilitate an understanding of the ways in which the invention may be practiced and to further enable those of skill in the art to practice its various embodiments. Accordingly, examples should not be construed as limiting the scope of what is disclosed and otherwise claimed.

Figure 4A:
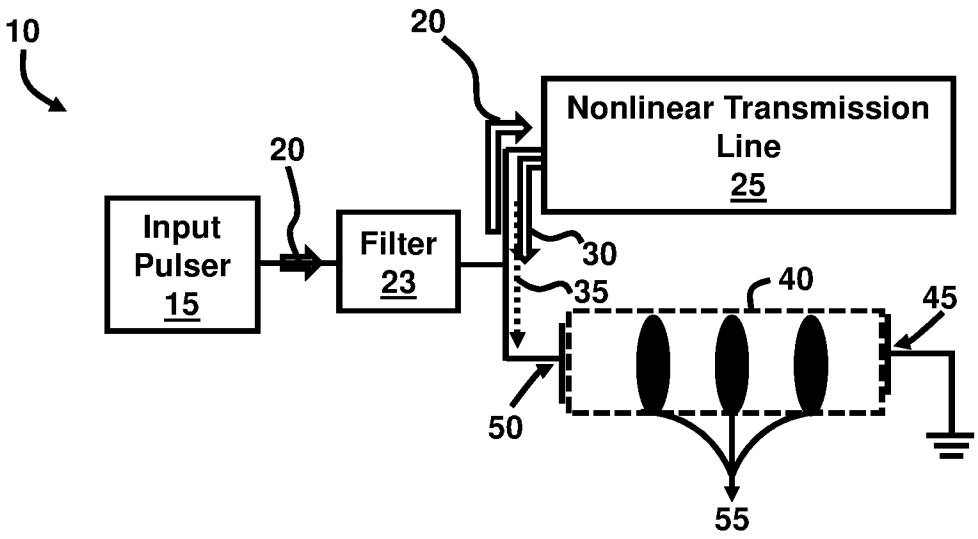
FIG. 4A is a block diagram of an apparatus for performing electron beam modulation, according to an embodiment herein.

In the drawings, the size and relative sizes of layers and regions may be exaggerated for clarity. The embodiments herein provide an input pulser that provides an electromagnetic pulse via an RF filter to a junction between a NLTL and an electron beam generating device. The NLTL forms a shock front when interacting with the electromagnetic pulse, which generates RF oscillations in a backward wave configuration. The backward wave RF oscillations are combined with the electromagnetic pulse and input into the electron beam generating device, which emits a modulated electron beam. The RF filter prevents the backward wave RF oscillations from interfering with the input pulser. The end of the NLTL is connected to a termination component, which grounds the electromagnetic pulses coming out of the NLTL. In another example, an antenna replaces the electron beam generating device. A backward wave NLTL beam modulator, wherein the RF oscillatory wave travels in the opposite direction as the injected electromagnetic drive pulse, offers a number of advantages over the forward wave devices. For example, for a given NLTL line length and frequency, a NLTL operating in a backward wave configuration will generate a substantially longer RF pulse than it will in a forward wave configuration, allowing for a relatively smaller system. Also, a backward wave device provides for greater consistency in RF oscillation amplitude compared to most forward wave devices. This enhanced uniformity in RF oscillation amplitude allows for greater uniformity of generated electron beam modulations. Referring now to the drawings, and more particularly to FIGS. 4A through 113F, where similar reference characters denote corresponding features consistently throughout, there are shown exemplary embodiments.

FIG. 4A, with reference to FIGS. 1A through 3B, illustrates an apparatus 10 for performing electron beam modulation. The apparatus 10 comprises an input pulser 15 to provide an electromagnetic pulse 20. A RF filter 23 is provided to filter the electromagnetic pulse 20 by isolating the input pulser 15 from high frequency electromagnetics. A NLTL 25 receives the electromagnetic pulse 20 and generates a backward wave RF oscillation 30 of a predetermined frequency to travel in a direction 35 opposite that of the electromagnetic pulse 20. As such, the RF filter 23 provides isolation between the input pulser 15 and the NLTL 25. An electron beam generating device 40 comprising an anode 45 and a cathode 50 is provided in the apparatus 10. The electron beam generating device 40 is to receive a combined electromagnetic pulse 20 from the RF filter 23 and the backward wave RF oscillation 30 from the NLTL 25 to cause excitation of a modulated voltage between the anode 45 and cathode 50, and to cause the electron beam generating device 40 to emit an electron beam 55 that is modulated at the predetermined frequency of the backward wave RF oscillation 30.

Figure 4B:
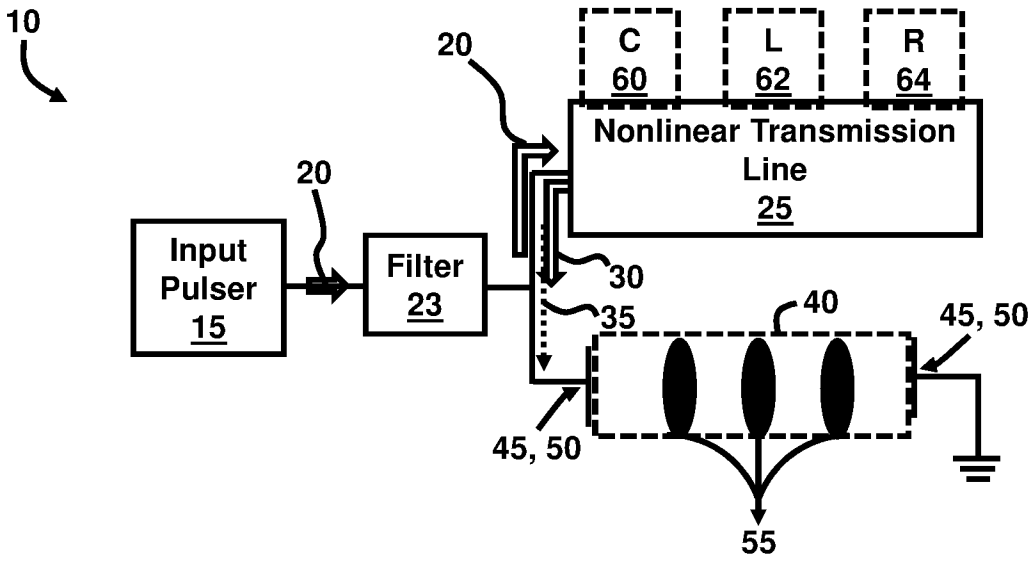
FIG. 4B is a block diagram further depicting components of the NLTL of the apparatus of FIG. 4A, according to an embodiment herein.
Figure 4C:
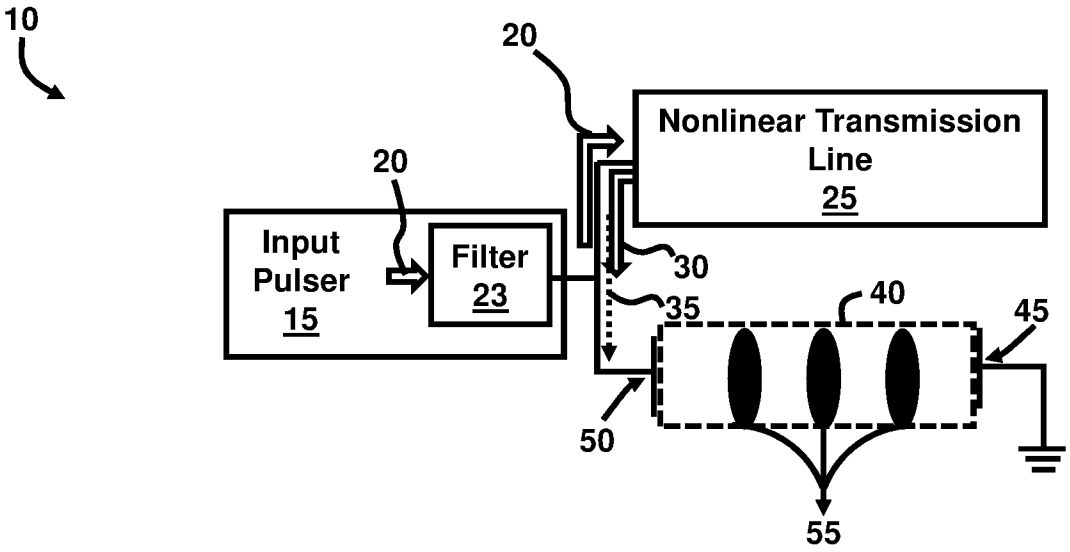
FIG. 4C is a block diagram depicting another arrangement of the input pulser of the apparatus of FIG. 4A, according to an embodiment herein.
Figure 4D:
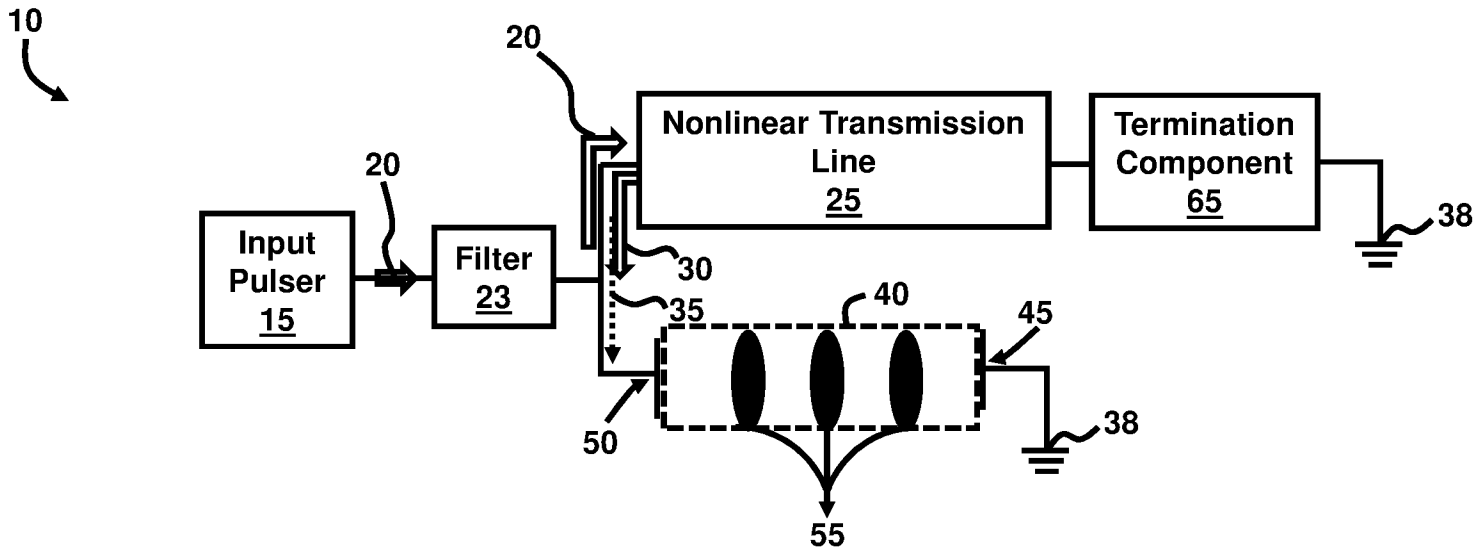
FIG. 4D is a block diagram of the apparatus of FIG. 4A with a termination component, according to an embodiment herein.

As shown in the block diagram of FIG. 4B, with reference to FIG. 1A through FIG. 4A, the NLTL 25 may comprise any of a capacitor 60 (C), inductor 62 (L), and resistor 64 (R), one or more of which have a nonlinear electromagnetic response. Any of the anode 45 and the cathode 50 may receive the combined electromagnetic pulse 20 and the backward wave RF oscillation 30. In other words, the combined electromagnetic pulse 20 and the backward wave RF oscillation 30 may be input into any of the anode 45 and cathode 50. In an example, the RF filter 23 may block the backward wave RF oscillation 30 from interacting with a portion of the input pulser 15. In another example, the RF filter 23 allows passage of the electromagnetic pulse 20 generated by the input pulser 15, but blocks or reflects the backward wave RF oscillation 30 generated by the NLTL 25 to prevent the backward wave RF oscillation 30 from entering the input pulser 15. Any of the anode 45 and cathode 50 may emit the modulated electron beam 55. As shown in FIG. 4C, with reference to FIGS. 1A through 4B, the input pulser 15 may contain the RF filter 23. As shown in FIG. 4D, with reference to FIGS. 1A through 4C, the apparatus 10 may comprise a termination component 65 to ground 38 the electromagnetic pulse 20 transmitted from the NLTL 25.

Figure 4E:
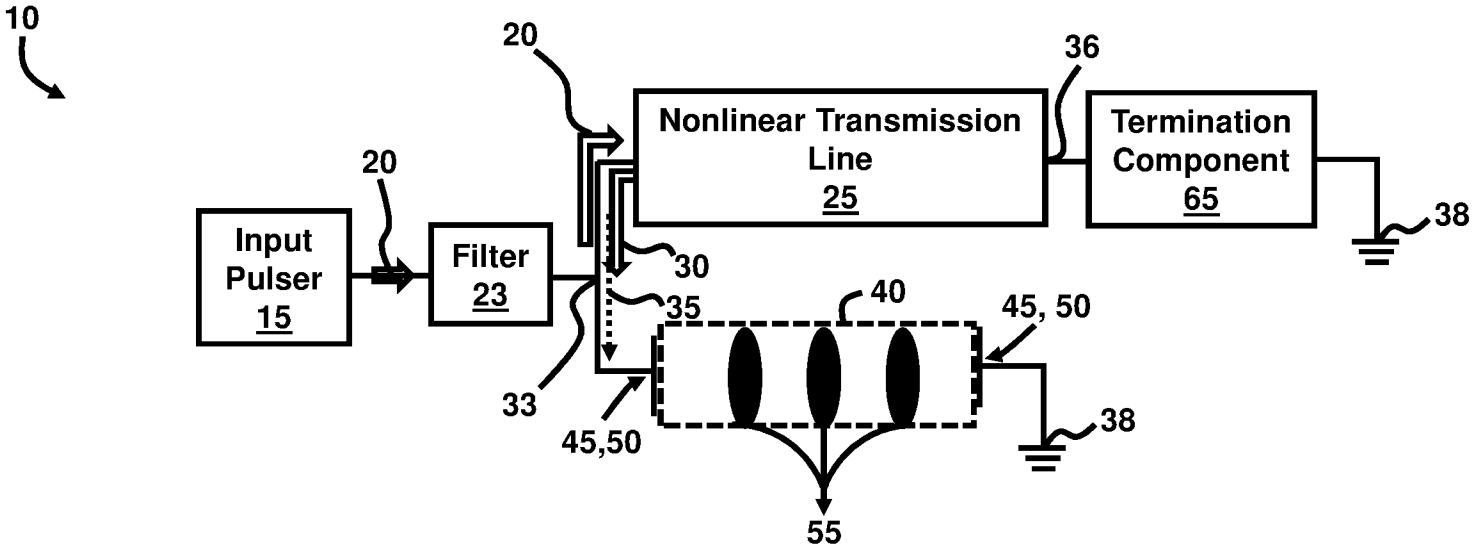
FIG. 4E is a schematic diagram of the backward wave NLTL of FIG. 4A, according to an embodiment herein.

As shown in FIG. 4E, with reference to FIGS. 1A through 4D, the input pulser 15 provides an electromagnetic pulse 20 via the RF filter 23 to a junction 33 between the NLTL 25 and the electron beam generating device 40. The NLTL 25 may be comprised of any of the NLTL circuits depicted in FIGS. 1A through 1C or by any other nonlinear transmission line circuit capable of generating RF oscillations in a backward wave configuration. Junction 33 may be operatively connected to either the anode 45 or cathode 50 of the electron beam generating device 40, depending on the polarity of the electromagnetic pulse 20 generated by the input pulser 15. The end 36 of the NLTL 25 opposite to the end connected to junction 33 is connected to termination component 65, which is, in turn, connected to ground 38.

Figure 4F:
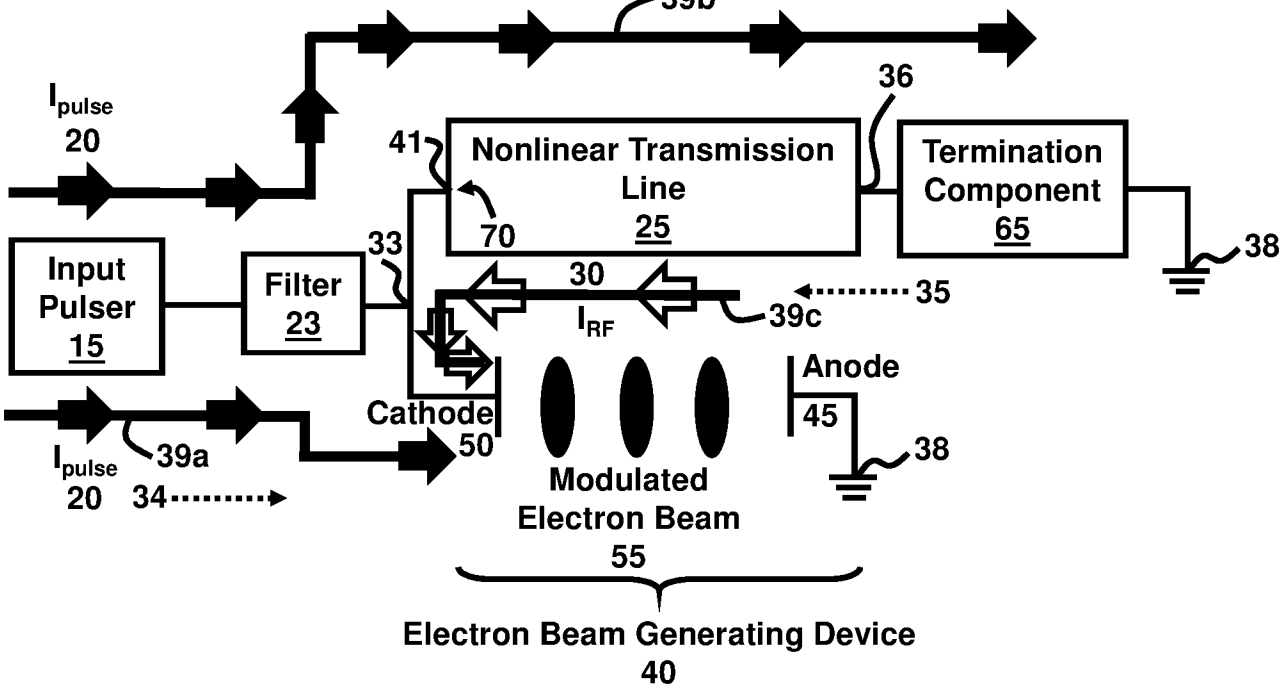
FIG. 4F is a schematic diagram illustrating the current paths through the backward wave NLTL of FIG. 4D, according to an embodiment herein.

As depicted by paths 39*a*, 39*b* in FIG. 4F, with reference to FIGS. 1A through 4E, the input pulser 15 supplies the electromagnetic pulse 20 to the electron beam generating device 40 and to connection 41 of the NLTL 25 via the RF filter 23 and junction 33. In the specific example depicted in FIG. 4F, junction 33 is shown to be connected to the cathode 50 of the electron beam generating device 40, indicating a negative polarity output from the input pulser 15. However, junction 33 could be connected to the anode 45 where there is a positive polarity output from the input pulser 15. Within the NLTL 25, the input drive electromagnetic pulse 20 continues to follow path 39*b*, and interacts with the NLTL 25 to form a shock front 70 and generates backward wave RF oscillation 30. The electromagnetic pulse 20 then exits the NLTL 25 via connection 36 and then interacts with termination component 65.

As indicated by path 39*c*, RF oscillations 30 generated within the NLTL 25 travel in a direction 35 opposite that of the direction 34 of the input electromagnetic pulse 20, and exit the NLTL via connection 41. These RF oscillations 30 then travel through junction 33 where they are blocked from entering the input pulser 15 by the RF filter 23 and, instead, travel to the input connection (e.g., at cathode 50) of the electron beam generating device 40. The RF filter 23 serves to prevent the RF oscillations 30 from interacting with portions of the input pulser 15 in which these RF oscillations 30 may cause unwanted effects but allows passage of the electromagnetic pulse 20 generated by input pulser 15. The RF filter 23 may represent a component as simple as a single inductor or may represent a more complex circuit which serves the required functionality. It is noted that while the RF filter 23 is represented as a component separate from the input pulser 15, it may, in some configurations, be a component internal to the input pulser 15, according to an example.

The electromagnetic pulse 20 from the input pulser 15 and the RF oscillatory wave (e.g., RF oscillation 30) from the NLTL 25 are combined at the input (e.g., at the cathode 50) of the electron beam generating device 40 where they excite a modulated voltage between the anode 45 and cathode 50 of the device 40. This modulated voltage causes the cathode 50 to emit an electron beam 55 which is modulated at the frequency of the RF oscillations 30 generated by the NLTL 25.

Generally, in order to generate microwave oscillations from the electromagnetic pulse 20, the NLTL 25 utilizes nonlinear material interactions that forms a portion of the electromagnetic pulse 20 (usually the leading edge) into an electromagnetic shock and maintains this shock as it travels down the NLTL 25. The shock then interacts with the dispersive structure of the NLTL 25 to generate a series of microwave frequency oscillations (e.g., RF oscillation 30) that are superposed on the portion of the electromagnetic pulse 20 that is trailing the shock. The formation and sustainment of this electromagnetic shock utilizes a specific type of nonlinearity (i.e., not all nonlinear materials are nonlinear in the right way to be useful in the NLTL 25). Accordingly, the nonlinear materials in the NLTL 25 set up a condition in the NLTL 25 in which the propagation velocity through the NLTL 25 is a function of signal amplitude. Additionally, this nonlinear effect is extremely broadband; in other words, this nonlinear effect occurs from DC or near-DC up to at least the frequency of the intended microwave output of the NLTL 25. These materials are also selected to be as low-loss as possible as lossy transmission line materials will substantially reduce microwave power output from the NLTL 25.

If the NLTL 25 utilizes bulk nonlinear dielectrics, this nonlinearity takes the form of a material with a permittivity that is a function of electric field (or voltage). Examples of this type of material are the ferroelectric ceramics, wherein the permittivity of the material decreases as the applied electric field (or voltage) increases. This change in permittivity is achieved by a distortion of the crystal lattice of the ceramic when it is immersed in a background electric field. Because propagation velocity through a given medium increases as permittivity decreases (assuming a constant permeability), for a Gaussian-like electromagnetic pulse 20 injected into the NLTL 25, the peak of the electromagnetic pulse 20 will travel faster than the low voltage leading foot of the pulse which will results in a steepening of the leading edge of the electromagnetic pulse 20 until a shock is formed. In a nonlinear dielectric NLTL 25 using lumped element semiconductor elements, such as varactors or reverse-biased Schottky diodes, the nonlinear capacitive elements have a lower capacitance at higher voltages than they do at lower voltages due to changes in the size of the depletion region within the semiconductor junction. A reduction in capacitance results in a lower effective transmission line permittivity, and thus, a higher propagation velocity for higher amplitude electromagnetic pulses 20.

In ferrite-based lines, the magnetic permeability of the line decreases with current amplitude due to realignment of the magnetic domains within the material until such point as the ferrite is saturated. Because propagation velocity along the NLTL 25 increases as permeability decreases, the higher amplitude portions of the input electromagnetic pulse 20 travel faster than the low amplitude portions, so the electromagnetic pulse 20 steepens and eventually forms an electromagnetic shock. As before, this shock, formed by the nonlinear amplitude-dependent propagation velocity properties of the NLTL 25, interacts with the dispersive structure of the NLTL 25 to generate microwave frequency oscillations superposed on the trailing portions of the electromagnetic pulse 20.

Figure 5A:
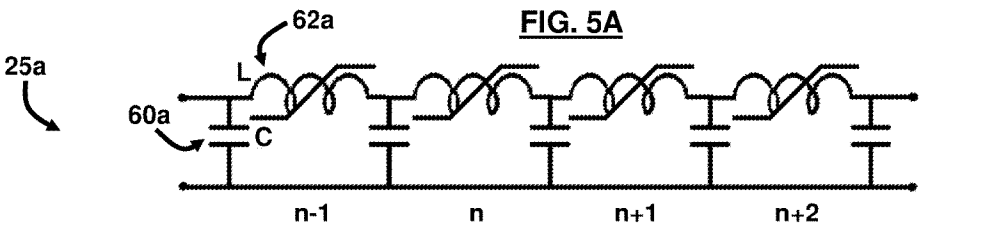
FIG. 5A is a schematic diagram of a section of a first ferrite-based NLTL, according to an embodiment herein.
Figure 5B:
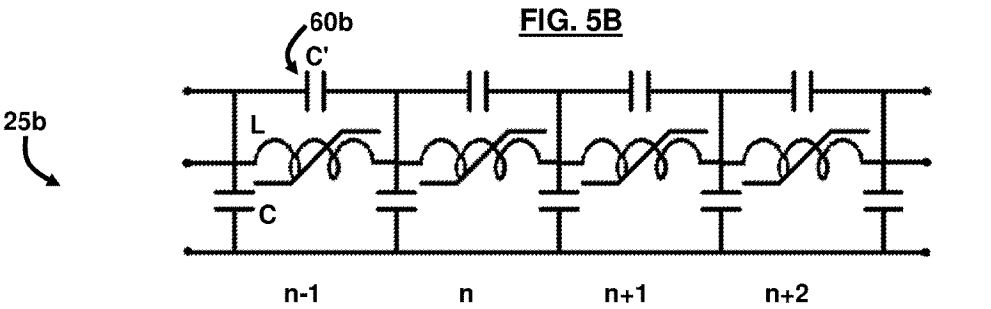
FIG. 5B is a schematic diagram of a section of a second ferrite-based NLTL, according to an embodiment herein.
Figure 5C:
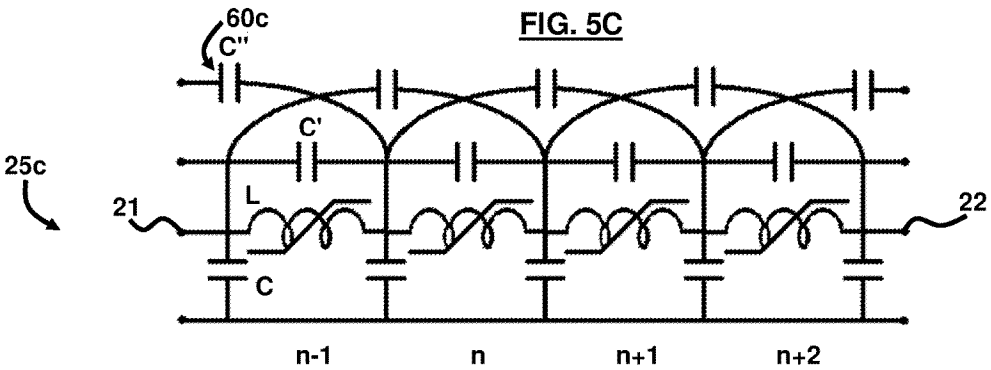
FIG. 5C is a schematic diagram of a section of a third ferrite-based NLTL, according to an embodiment herein.

FIGS. 5A through 5C, with reference to FIGS. 1A through 4F, show example circuit schematic representations of NLTLs 25*a*-25*c* comprised of periodic arrangements of capacitive elements 60*a* (also referred to herein as "capacitor" or "C") and inductive elements 62*a* (also referred to herein as "inductor" or "L"), which may be utilized in accordance with the embodiments herein. In each of these depicted circuit schematic examples, the circuit element providing the beneficial nonlinear behavior is a nonlinear magnetic element, which acts as a nonlinear inductor 62*a* (L). For the NLTLs 25*a*-25*c* depicted in FIGS. 5A through 5C, the capacitor 60*a* (C) are assumed to be linear. While not shown in FIGS. 5A through 5C, any of the circuit elements may also include resistive elements including shunt or series resistance. While each of the depicted NLTLs 25*a*-25*c* in FIGS. 5A through 5C are four periods long, this is merely an example, and accordingly the NLTL section can be comprised of any number of such periods. Additionally, while the exemplary NLTLS 25*a*-25*c* depicted in FIGS. 5A through 5C use only nonlinear magnetic elements, the NLTLs 25*a*-25*c* may also derive their beneficial nonlinear properties from nonlinear capacitive elements 60*a* containing nonlinear dielectric materials or a combination of nonlinear capacitive and inductive elements 60*a*, 62*a*.

The NLTL 25*a* depicted in FIG. 5A is comprised of periodic sections containing only a nonlinear capacitor 60*a* (C) and a nonlinear inductor 62*a* (L). The NLTL 25*b* shown in FIG. 5B includes a shunt capacitor 60*b* (C') between terminals of each inductor 62*b* (L). The NLTL 25*c* of FIG. 5C provides an additional capacitive element 60*c* (C") which couples a given circuit node to another that is two periods away.

The nonlinear magnetic NLTLs 25*a*-25*c* may include additional circuitry or hardware to bias the nonlinear magnetic elements, which are usually ferrites. This biasing circuitry or hardware may take the form of a magnetic field coil (not shown) that immerses the entire NLTL 25*a*-25*c* in a magnetic field. In an example, the biasing circuitry may be configured such that a DC current can be run through the nonlinear magnetic elements via connections to a set of circuit nodes, such as nodes 21, 22, as shown in NLTL 25*c*. The magnetic field generated by the coil or by the flowing current will allow the initial alignment of the magnetic domains of the nonlinear magnetic elements (ferrites) to be changed, which allows the propagation velocity of the electromagnetic shock to be controlled by a limited degree.

Figures 1A, 1B, 1C:
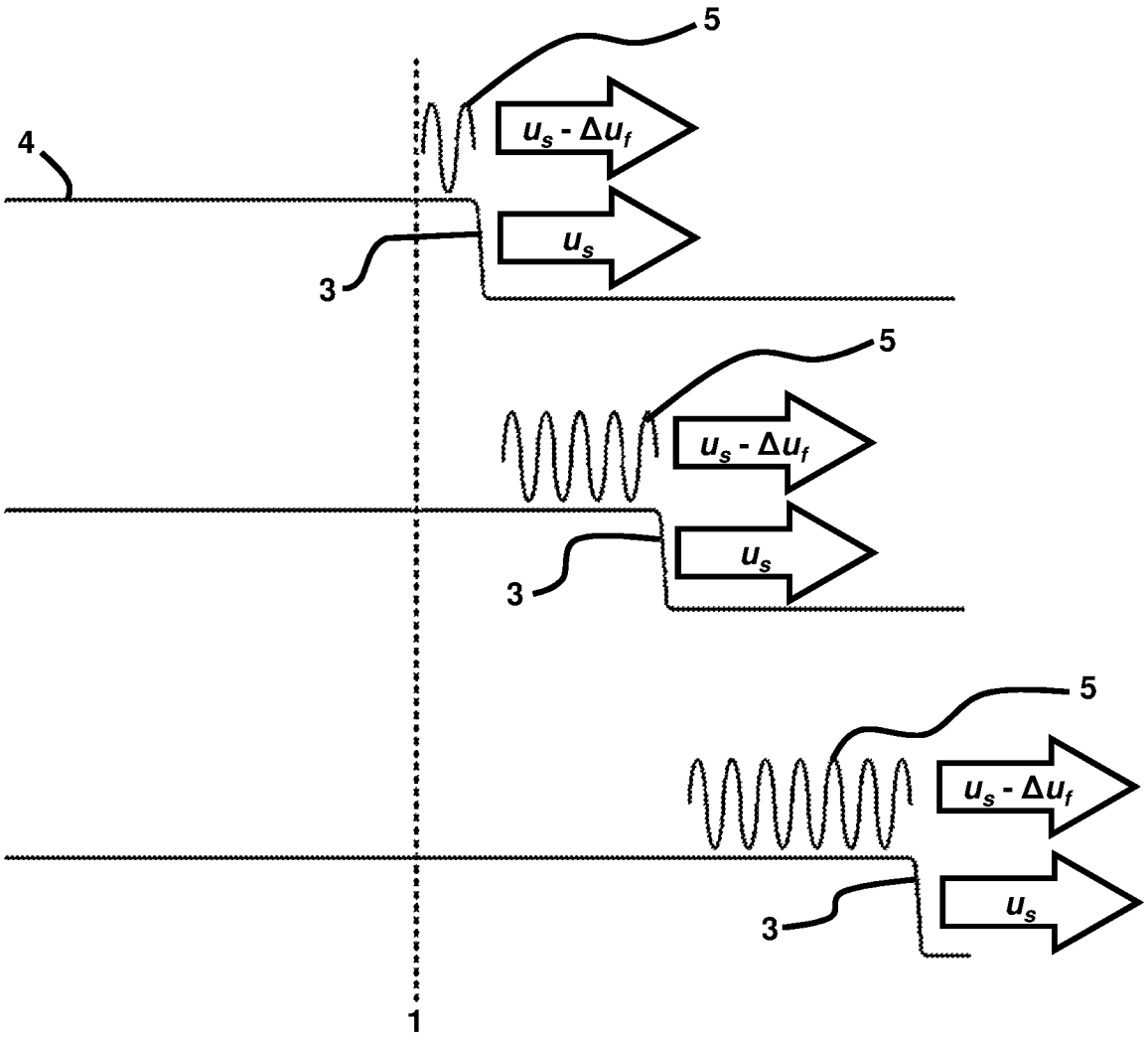
FIG. 1A (Prior Art)
FIG. 1B (Prior Art)
FIG. 1C (Prior Art)
FIG. 1A is a schematic diagram illustrating a first sequence of the formation process for electromagnetic oscillations in a conventional forward wave NLTL.
FIG. 1B is a schematic diagram illustrating a second sequence of the formation process for electromagnetic oscillations in a conventional forward wave NLTL.
FIG. 1C is a schematic diagram illustrating a third sequence of the formation process for electromagnetic oscillations in a conventional forward wave NLTL.
Figure 2:
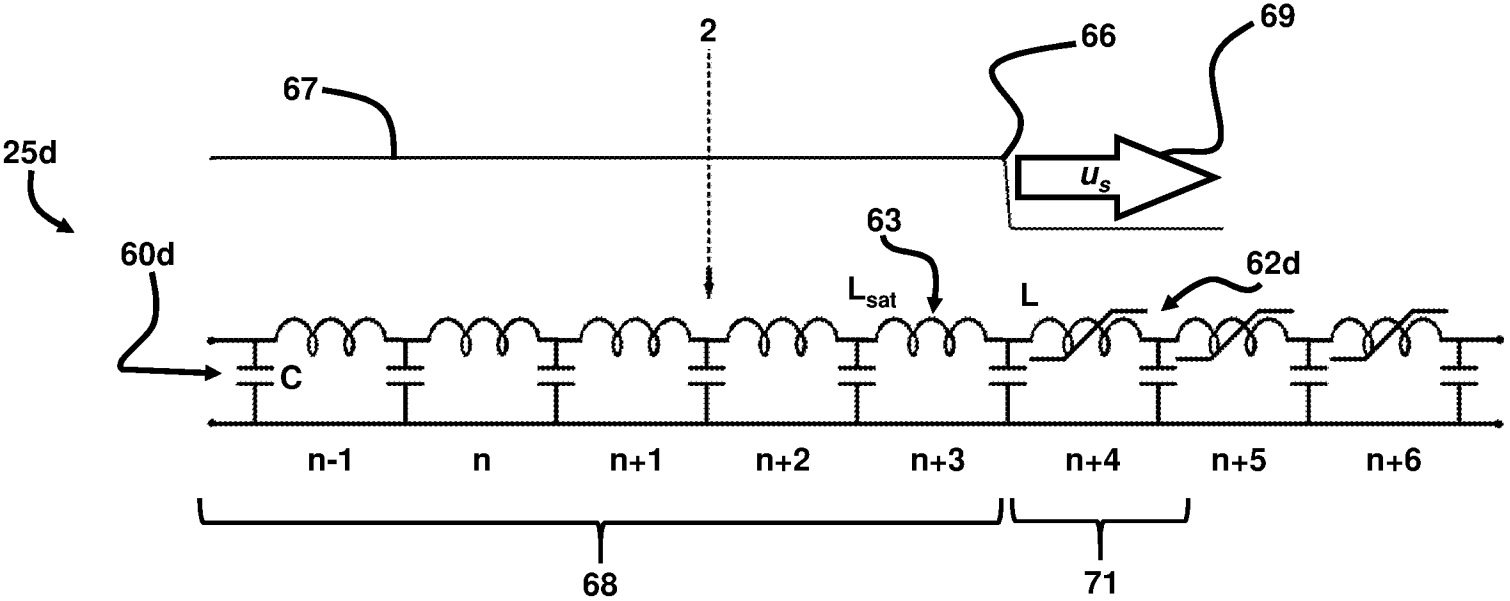
FIG. 2 (Prior Art)
FIG. 2 is a schematic of a conventional NLTL circuit of the type shown in FIG. 1A with a representation of an electromagnetic shock traversing the transmission line and driving nonlinear inductive elements into saturation.
Figure 3A:
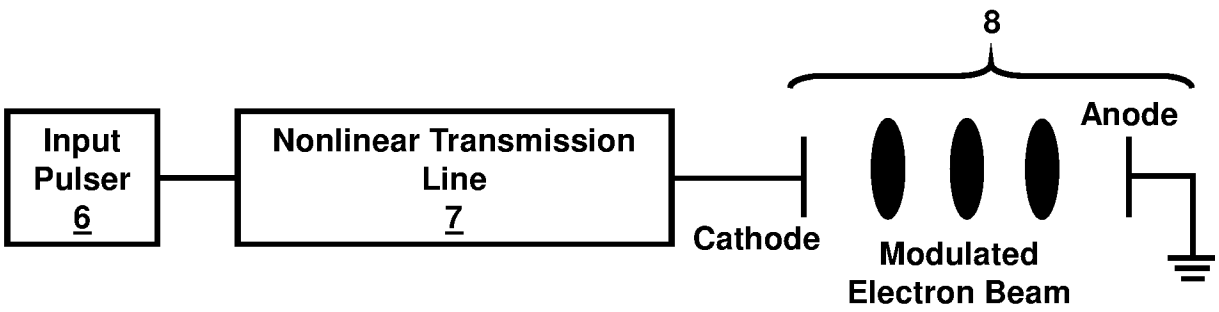
FIG. 3A (Prior Art)
FIG. 3A is a schematic diagram of a conventional forward wave NLTL beam driver.
Figure 3B:
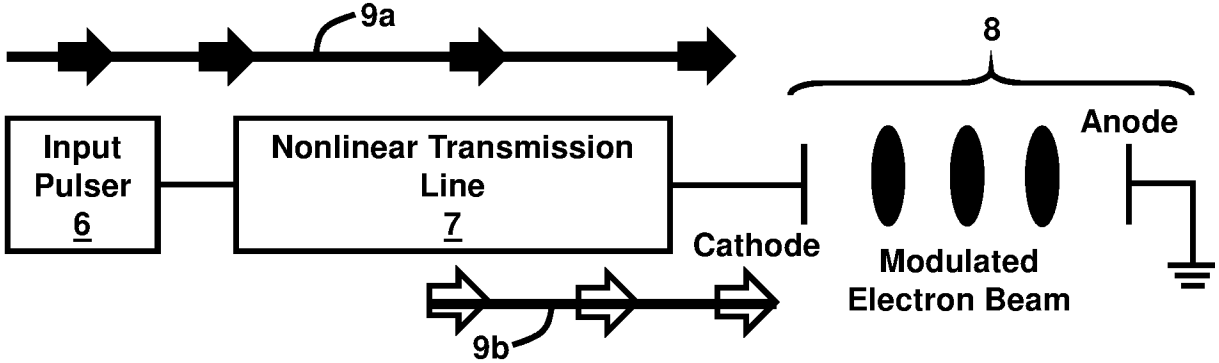
FIG. 3B (Prior Art)
FIG. 3B is a schematic diagram of a conventional forward wave NLTL beam driver as well as current flow paths within the device.

It can be shown that for a linear transmission line of the type shown in FIG. 2, the angular frequency ω of an electromagnetic wave propagating in the saturated portion of the region 68 can be described as a function of the wave number k in the equation:

$$\omega = 2\omega_{LC}\sin\left(\frac{kd}{2}\right) \tag{1}$$

where $\omega=2\pi f$, $k=2\pi/\lambda$, $\omega_{LC}=(CL_{sat})^{-0.5}$, f is the frequency, Δ is the wavelength, and d is the physical length of one period of the NLTL 25*d*. C and $L_{sat}$ are the capacitance and saturated inductance of elements 60*d*, 63, respectively, of each stage in region 68.

Figures 6A, 6B:
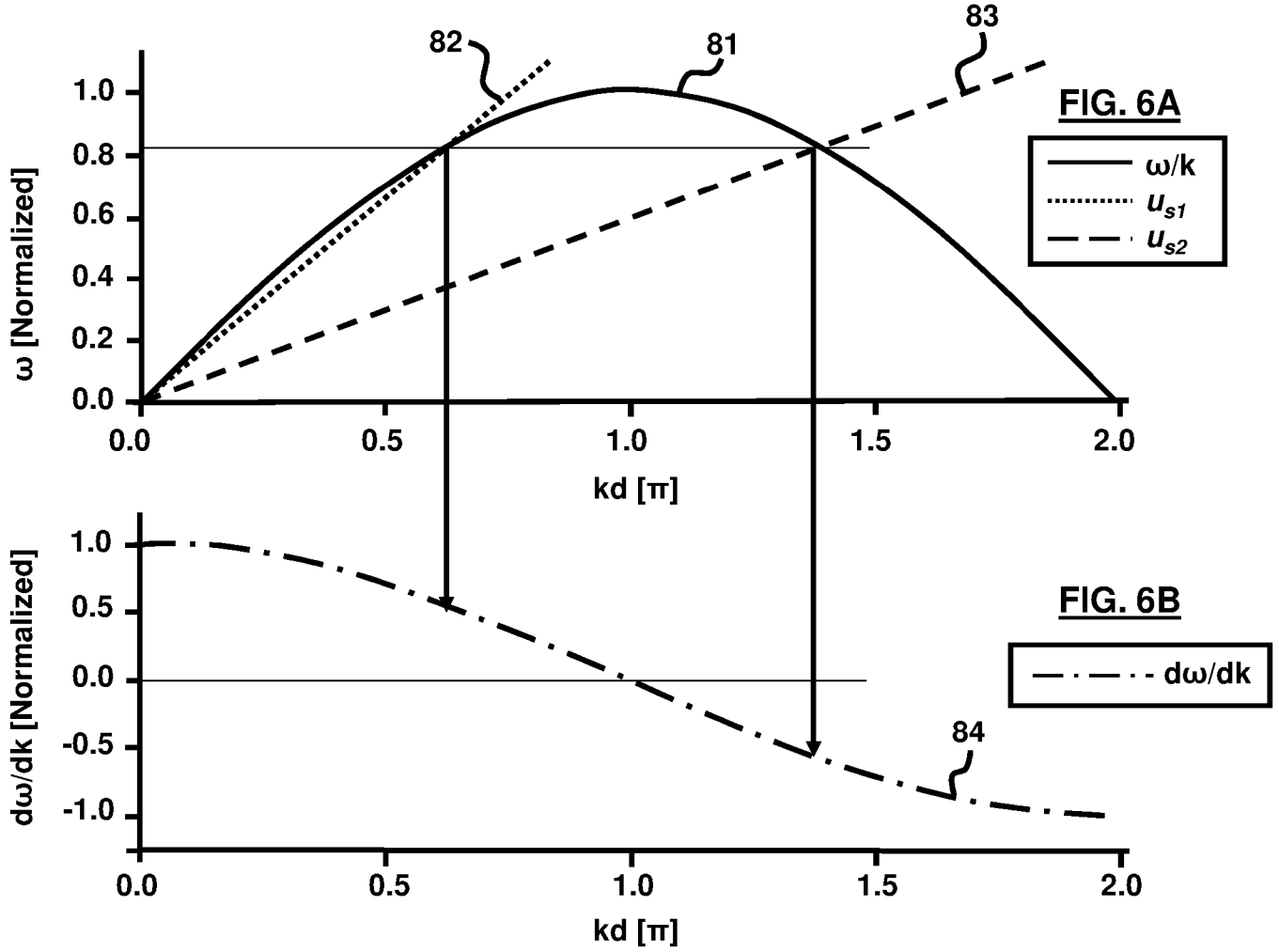
FIG. 6A is a plot of the dispersion diagram of a saturated NLTL, according to an embodiment herein.
FIG. 6B is a plot of the group velocity of RF waves as a function of phase shift per NLTL period, according to an embodiment herein.

A plot of ω as a function of the phase shift per period, kd, is provided in FIG. 6A. The plot relates ω, the radial frequency of a wave propagating within saturated transmission line region 68 of FIG. 2, to kd, the phase shift (in radians) of the wave per transmission line period, and is plotted as curve 81 in FIG. 6A. Effectively, any point along curve 81 describes an allowed combination of angular frequency, ω, and phase shift per stage, kd, that an electromagnetic wave within the line may have (i.e., a RF mode).

The propagation velocity of the electromagnetic shock front, $u_s$, is related to a number of parameters, including material and geometric properties of the ferrites and transmission line, the shock current (e.g., the current associated with the electromagnetic shock) $I_s$, and the saturation state of the ferrites. For the purposes of plotting the shock propagation velocity on the dispersion plot in FIG. 6A, the following equation is utilized:

$$\omega = \frac{u_s}{d} * (kd). \tag{2}$$

For the purposes of the present example, two different shock velocities, $u_{s1}$ and $u_{s2}$, where $u_{s1}>u_{s2}$, represented by lines 82, 83, respectively, are plotted. As described previously, the shock velocity is related to the saturation state of the ferrites (which can be altered by employing one of the aforementioned biasing methods). Thus, $u_{s1}$ and $u_{s2}$, could represent shock propagation velocities in a given NLTL under two different biasing levels. Energy couples from the shock front into RF waves having phase velocities (i.e., phase velocity, $u_{phase}$ is equal to ω/k) matching the shock velocity (also called synchronous waves). These synchronism conditions are represented on the dispersion plot by intersections of the shock propagation velocity line and curve 81.

As shown in FIG. 6A, it is possible for two different shock propagation velocities (e.g., lines 82, 83) to excite RF waves with the same angular frequency. While the frequency of RF oscillations excited by shocks with velocities (e.g., lines 82, 83) may be the same, an important distinction between these oscillations becomes apparent when the group velocity of the waves is considered. The group velocity of a train of RF oscillations is the velocity at which the energy carried by the wave propagates along the transmission line. It is noted that the phase velocity and the group velocity of an RF wave are not necessarily the same. The group velocity of an RF wave propagating along region 68 of the NLTL 25*d* in FIG. 2 is defined as the partial derivative of w with respect to k:

$$u_{group} = \frac{\partial\omega}{\partial k} = d\omega_{LC}\cos\left(\frac{kd}{2}\right), \tag{3}$$

which is plotted as curve 84 in FIG. 6B. As is evident from a comparison of the plots in FIGS. 6A and 6B, the RF wave excited by the shock with the faster velocity, $u_{s1}$, has a positive group velocity, while the RF wave excited by the shock with the slower velocity, $u_{s2}$, has a negative group velocity. The RF wave excited by the faster shock and having a positive group velocity is defined as a "forward wave" which has a propagation velocity aligned along the same direction as the shock front, and as described with reference to FIGS. 1A through 1C. The RF wave excited by the slower shock and having a negative group velocity is defined as a "backward wave" in accordance with the embodiments herein with reference to FIGS. 4A through 4F, which has a propagation velocity aligned in the opposite direction as the shock front 70.

Figures 7A, 7B, 7C:
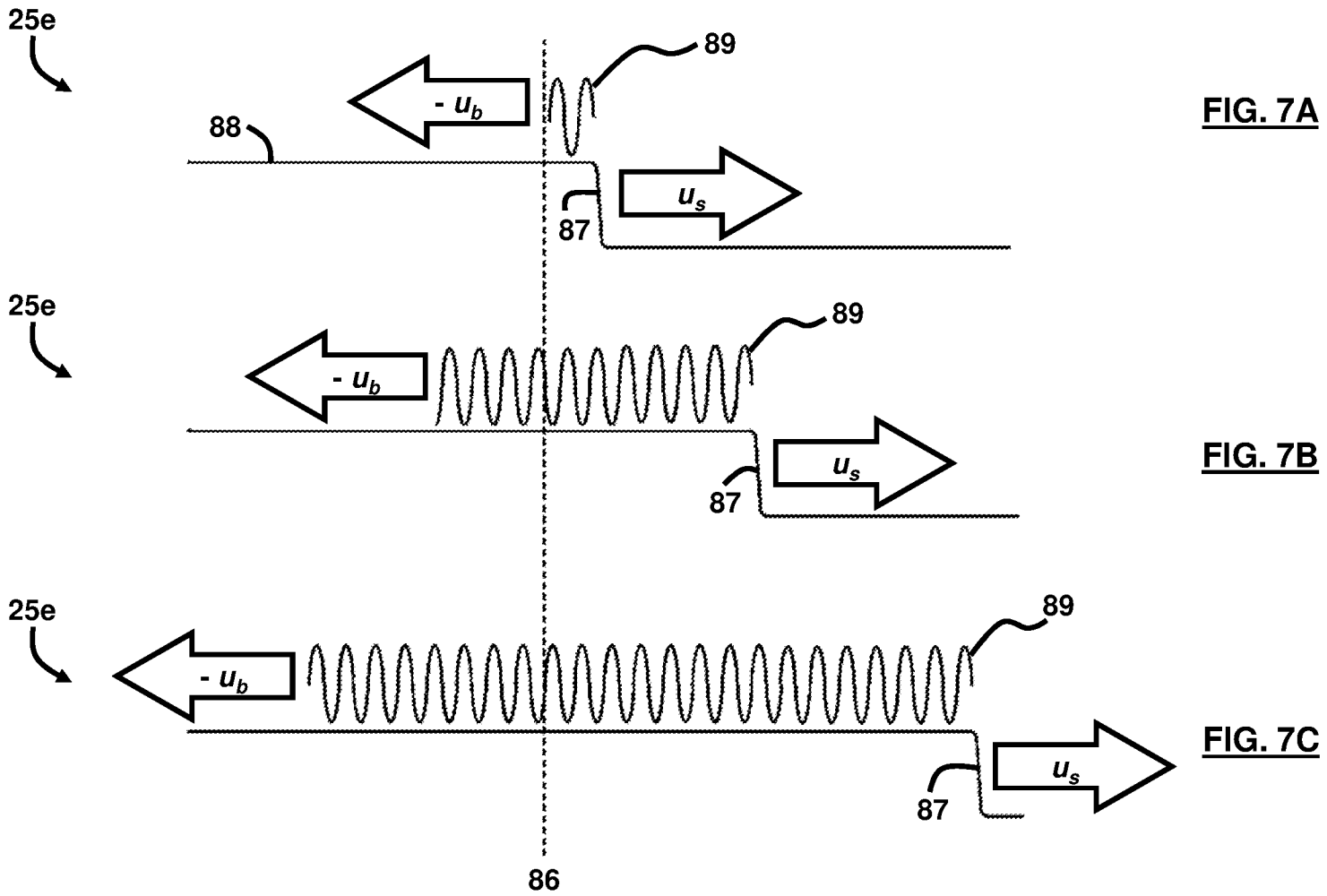
FIG. 7A is a schematic diagram illustrating a first sequence of the formation process for electromagnetic oscillations in a backward wave NLTL, according to an embodiment herein.
FIG. 7B is a schematic diagram illustrating a second sequence of the formation process for electromagnetic oscillations in a backward wave NLTL, according to an embodiment herein.
FIG. 7C is a schematic diagram illustrating a third sequence of the formation process for electromagnetic oscillations in a backward wave NLTL, according to an embodiment herein.

The illustrations provided in FIGS. 7A through 7C, with reference to FIGS. 1A through 6B, depict the RF generation process occurring within a NLTL 25*e* operating in a backward wave mode. For the purposes of the illustrations in FIGS. 7A through 7C, losses within the NLTL 25*e* are neglected. Additionally, the RF and input current pulse contributions (which are associated with RF and input pulse voltages) are shown separately. It is assumed that the measured current at any point along the NLTL 25*e* would show a superposition of the input pulse current and the oscillatory RF current. The dotted vertical line 86 represents a fixed position along the length of the NLTL 25*e*, for reference.

In FIG. 7A, the shock front 87, which is formed at the leading edge of the input current pulse 88, propagates down the length of the NLTL 25*e* at velocity $u_s$ and RF oscillations 89 are generated. Due to a combination of the capacitive and inductive elements (not shown in FIGS. 7A through 7C) within the NLTL 25*e* as well as the shock propagation speed allowed by the material properties and bias level of the nonlinear elements, the oscillatory RF wave generated at the shock front propagate away from the shock front 87 with a velocity directed in the opposite direction as the velocity of the shock front 87. The velocity of the wave is defined as $-u_b$. As these RF oscillations travel in a direction opposite that of the shock front 87, additional oscillations are continuously generated by the shock front 87, as shown in FIG. 7B. In this manner, the train of RF oscillations away from the shock front 87 traveling in the opposite direction down the line as the shock front 87, as shown in FIG. 7C.

Figure 8A:
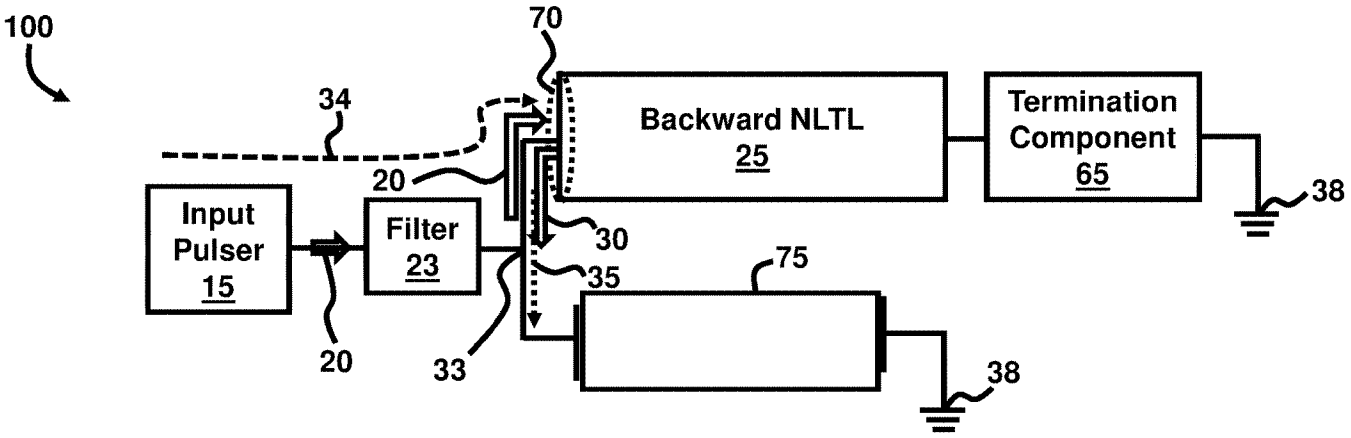
FIG. 8A is a block diagram illustrating a system for performing electron beam modulation using a backward NLTL, according to an embodiment herein.
Figure 8C:
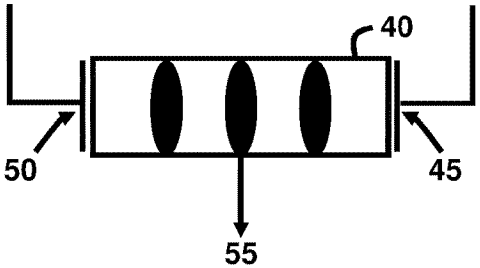
FIG. 8C is a block diagram of the system of FIGS. 8A and 8B further depicting the electron beam generating device, according to an embodiment herein.

FIG. 8A, with reference to FIGS. 1A through 7C, illustrates another embodiment herein that provides a system 100 comprising an input pulser 15 to generate an electromagnetic pulse 20 to travel in a first direction 34. A filter 23 is provided to control the electromagnetic pulse 20. A backward wave NLTL 25 is provided to interact with the electromagnetic pulse 20 to form a shock front 70, and generate a backward wave RF oscillation 30 to travel in a second direction 35 opposite that of the first direction 34. A termination component 65 is provided to ground 38 the electromagnetic pulse 20 transmitted from the NLTL 25. A device 75 is provided to receive the electromagnetic pulse 20 from the filter 23 and the backward wave RF oscillation 30 from the NLTL 25.

Figure 8B:
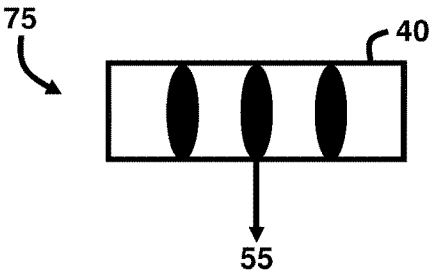
FIG. 8B is a block diagram of the system of FIG. 8A with an electron beam generating device to emit an electron beam, according to an embodiment herein.
Figure 8D:
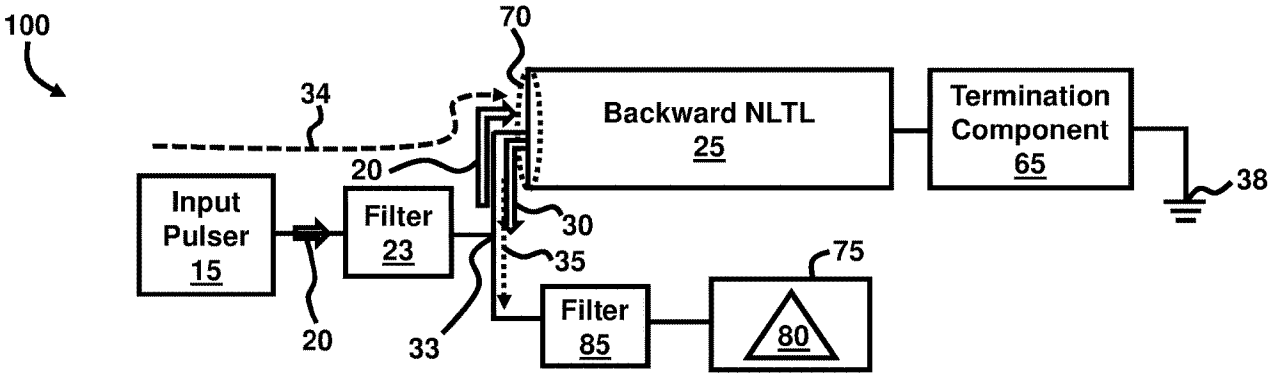
FIG. 8D is a block diagram of the system of FIG. 8C with an antenna, according to an embodiment herein.
Figure 8E:
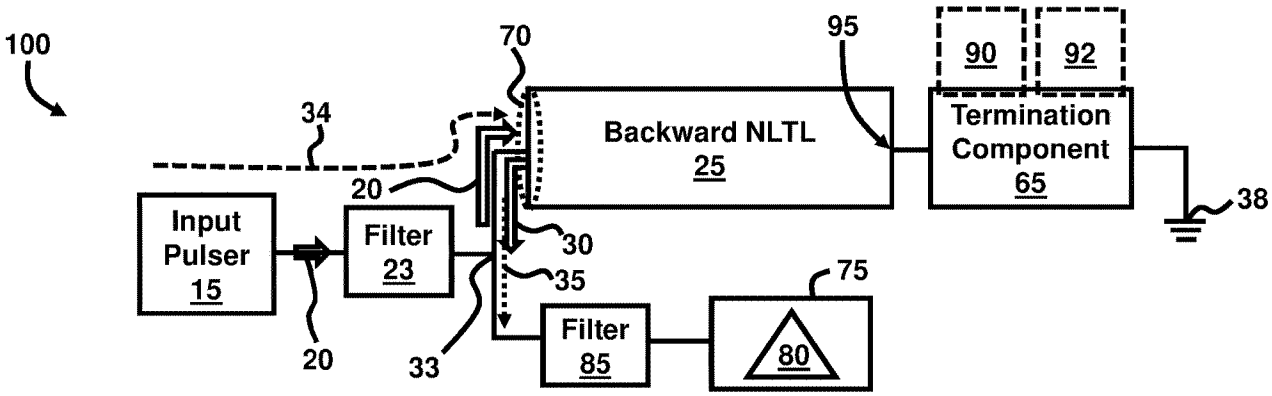
FIG. 8E is a block diagram of the system of FIG. 8A with a termination component, according to an embodiment herein.

As shown in FIG. 8B, with reference to FIGS. 1A through 8A, the device 75 may comprise an electron beam generating device 40 to emit an electron beam 55 that is modulated at a frequency of the backward wave RF oscillation 30. As shown in FIG. 8C, with reference to FIGS. 1A through 8B, the electron beam generating device 40 may comprise an anode 45 and a cathode 50. The polarity of the electromagnetic pulse 20 may determine whether the electromagnetic pulse 20 enters the electron beam generating device 40 through either the anode 45 or cathode 50. As shown in FIG. 8D, with reference to FIGS. 1A through 8C, the device 75 may comprise an antenna 80. The antenna 80 may be any suitable type of antenna such as an omnidirectional antenna, directional antenna, monopole antenna, or dipole antenna, according to some examples. The system 100 may comprise a high pass filter 85 between the NLTL 25 and the antenna 80. The termination component 65 may comprise any of a metal oxide varistor 90 and a Zener diode 92, or an electromagnetically equivalent component (not shown), in series with a termination load 95 of the NLTL 25, as depicted in FIG. 8E, with reference to FIGS. 1A through 8D. The metal oxide varistor 90 or electromagnetically equivalent component may be set to conduct at a voltage level of approximately a peak value of the input pulser 15.

The techniques provided by the embodiments herein convert common available power from sources such as AC power from a wall plug or DC power from batteries, into RF power either through a modulated electron beam 55 in a vacuum electronics device or directly out of an antenna 80. The backward wave NLTL 25 confers advantages in pulse length and stability compared to forward wave devices, thereby advancing the state of the art.

The input pulser 15 (or pulse generator) is the first stage in the aforementioned conversion of power. The input pulser 15 can range from commercially available scientific equipment to custom one-of-a-kind devices, but for the purposes of the embodiments herein, the input pulser 15 is configured to convert power from the available power source into a form that is used by the NLTL 25.

The NLTL 25 utilizes a high voltage, high current pulse which it partially converts into RF energy. The NLTL 25 utilizes a relatively high voltage pulse to function, as the nonlinear components react differently to high voltage compared to low voltage. According to the embodiments herein, the production of the backward wave RF oscillation 30 using a backward wave interaction offers an improvement over the conventional solutions. This interaction produces the RF oscillation 30 that travels in the opposite direction (e.g., second direction 35) of the incident voltage electromagnetic pulse 20. The generated RF oscillation 30 has a longer duration when compared to an RF pulse created by a forward wave interaction. The input electromagnetic pulse 20 into the NLTL 25 must be dealt with in some way when it reaches the end of the NLTL 25. There are drawbacks to open and short terminations, thus in one example, the system 100 provided by the embodiments herein utilizes a metal oxide varistor 90 to be the desired termination, which is unique compared to the conventional solutions.

In addition, since this is a backward wave interaction, the RF oscillation 30 is returned down the input line back toward the input pulser 15. Typically, an input pulser 15 is not configured to handle return current, thus the filter 23 is included. The filter 23 directs the RF oscillation (e.g., pulse) 30 to the cathode 50 instead of back into the input pulser 15. From there, the cathode 50 converts the RF oscillation 30 into a bunched electron beam 55, or the RF oscillation 30 is filtered again through the high pass filter 85 and sent directly to the antenna 80. In whichever manner, the electrons are emitted (e.g., high field, heat, etc.), and they are accelerated by the difference in potential between the cathode 50 and anode 45. Since this potential changes with time due to the RF oscillation 30, the velocity of the electrons that are emitted also changes with time, leading to the bunched electron beam 55.

An additional implementation of the backwards wave NLTL 25 with the termination component 65 is the direct driving of the antenna 80 with the generated RF oscillation 30. In this alternate implementation, the electrical arrangement of the antenna 80 relative to the NLTL 25 facilitates backwards wave RF extraction, while the termination component 65 prevents excessive reflections and increases efficiency.

Figure 8F:
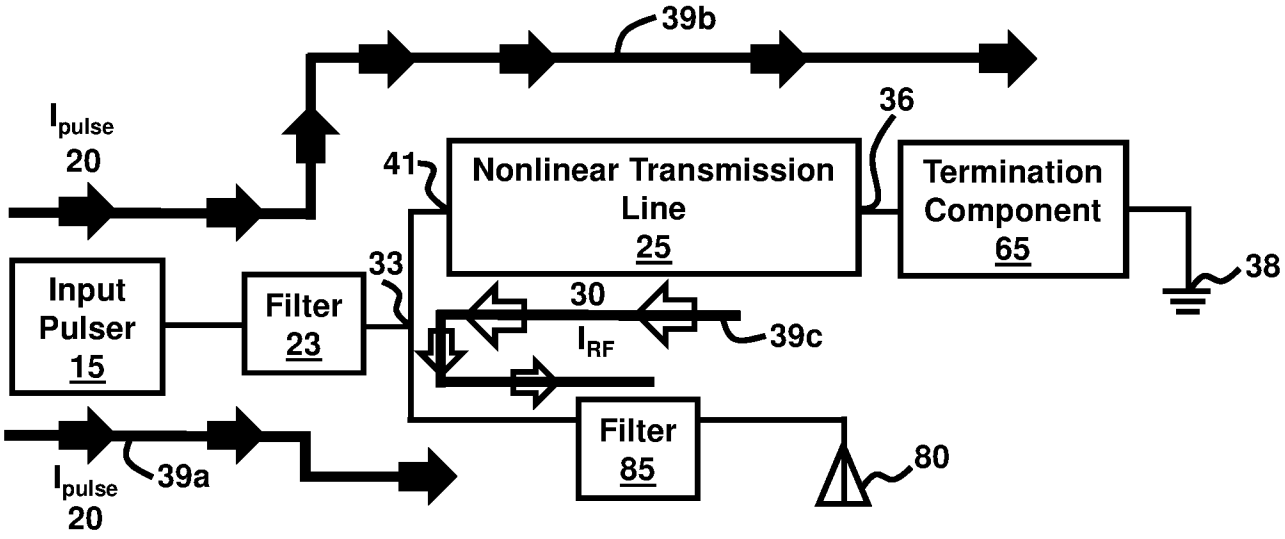
FIG. 8F is a schematic diagram of a backward wave NLTL with metal oxide varistor (MOV)-like end termination for directly driving an antenna with the generated RF current oscillations, according to an embodiment herein.

The additional implementation of the backwards wave NLTL with metal oxide varistor (MOV)-like end termination providing directly driving the antenna 80 with the generated RF oscillations 30 is depicted in FIG. 8F, with reference to FIGS. 1A through 8E, which demonstrates this configuration with the RF antenna 80, and the high pass filter 85. The high pass filter 85 is not required, but may be implemented to improve system efficiency by preventing the input electromagnetic pulse 20 being diverted from the NLTL 25 to the antenna 80. The electrical arrangement of the antenna 80 relative to the NLTL 25 facilitates backwards wave RF extraction, while the MOV-like end termination prevents excessive reflections and increases efficiency.

Figure 8G:
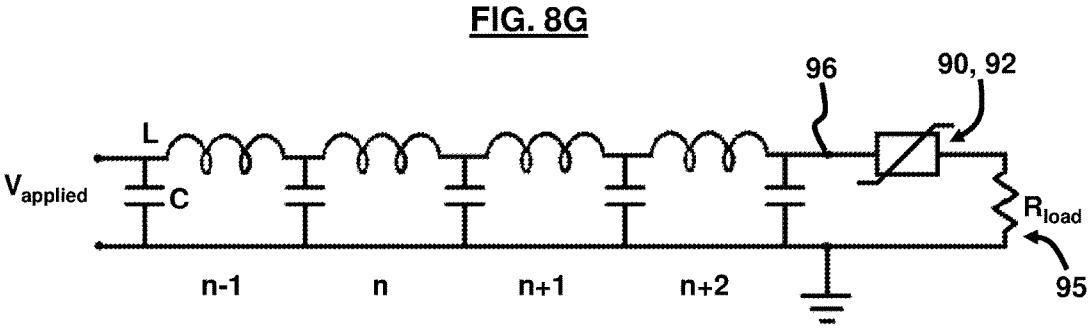
FIG. 8G is a schematic diagram of a backward wave NLTL terminated with a MOV in series with a fixed-impedance load, according to an embodiment herein.

In applications, such as priming a high power microwave source, it may be desirable to maintain electron emission from the cathode 50 of the electron beam generating device 40 for a period of time longer than the time taken for the electromagnetic shock front 70 to transit the entire length of the NLTL 25. For these types of applications, a termination component 65 that limits reflections back into the NLTL 25, but reduces or eliminates parasitic current flow is desirable. The termination component 65 including a circuit element (or combination of elements) such as the metal oxide varistor (MOV) 90, as depicted in FIG. 8G, with reference to FIGS. 1A through 8F, or the Zener diode 92 in series with the NLTL termination load 95 provides the desired functionality.

Figure 8H:
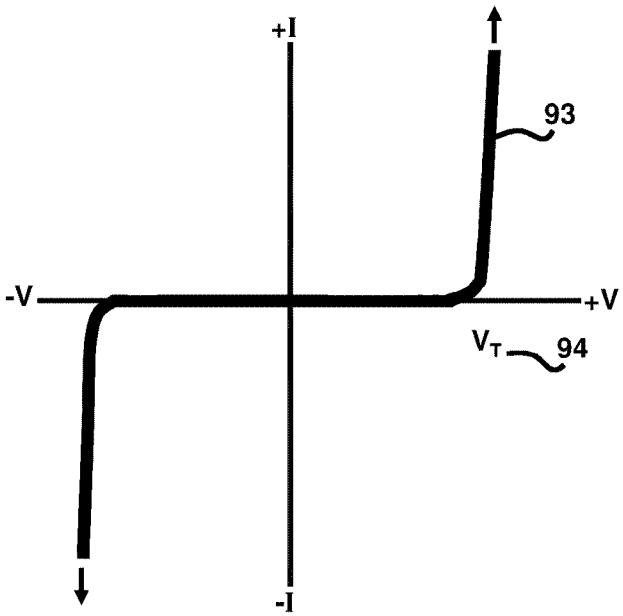
FIG. 8H is a current-voltage plot of the general response of a MOV, according to an embodiment herein.

The MOV 90 may be a solid state component having properties generally described by curve 93 on the current versus voltage plot provided in FIG. 8H, with reference to FIGS. 1A through 8G. The MOV 90 serves as highly resistive element up to a threshold voltage 94, beyond which it (the MOV 90) rapidly transitions to a highly conductive state. If the voltage drops below the threshold 94, the MOV 90 will transition back to a highly resistive state. This effect occurs for both positive and negative voltages. The Zener diode 92 provides similar functionality but with substantially reduced power handling capabilities compared with the MOV 90.

For a series arrangement of MOVs, the threshold voltage of the series is equivalent to the sum of the threshold voltages 94 of each MOV 90 comprising the series. In this manner, very high voltage thresholds may be achieved to match the output voltages of high voltage pulsers. If large current handling requirements are expected, parallel MOV elements may be added to ensure any one MOV 90 does not pass excessive current. Thus, a given MOV 90 may include more than one MOV in some series and/or parallel arrangement.

MOVs are typically utilized in surge suppressor applications wherein they are placed in a shunt configuration across a load. If a potentially damaging voltage surge is incident on the load and shunt MOV, the MOV will rapidly transition to a conductive state and provide a low impedance path for the surge current to flow along a parallel path to ground, thus mitigating potential damage to the load.

In accordance with the embodiments herein, the MOV 90 or MOV-like element (e.g., Zener diode 92) is placed in series with the NLTL termination load 95. The threshold voltage 94 of the MOV 90 is preferentially chosen to be at or near the flat top (or peak) voltage of the input pulser 15. When the shock front 70 transits the NLTL 25 and encounters the MOV 90 in its initially high impedance state, the voltage at the input terminal 96 (shown in FIG. 8G) of the MOV 90 will begin to increase as a reflected pulse begins to develop as would be expected when terminating transmission lines with a high impedance. The MOV 90 will transition to a conductive state and allows current flow through the termination load 95 until the voltage at the MOV terminal drops back below the MOV threshold voltage 94. In this manner, reflections back into the NLTL 25 are minimized as is parasitic current flow through the NLTL 25.

Figure 9:
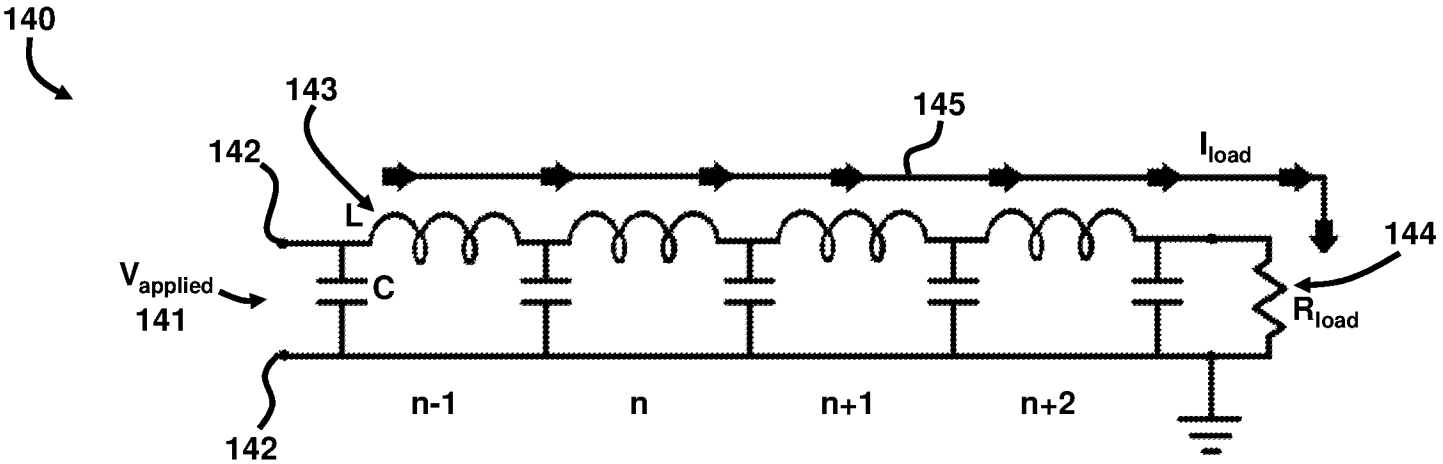
FIG. 9 is a schematic diagram of a backward wave NLTL terminated with a fixed-impedance load, according to an embodiment herein.

Backward wave NLTLs are typically indicated to be terminated with either fixed impedance resistive elements or by a frequency-dependent impedance load intended to match the transmission line impedance at all frequencies (including DC). This type of NLTL termination can be utilized with the backward wave NLTL beam modulator 140, as shown by the schematic depicted in FIG. 9, with reference to FIGS. 1A through 8H, but may present undesirable challenges in long pulse applications. For the purposes of the schematic depicted in FIG. 9, it is assumed that the shock front has already fully transited the NLTL beam modulator 140, but the input pulser 15 is still generating a voltage 141 across the terminals 142 of the saturated NLTL beam modulator 140. Because the NLTL beam modulator 140 is assumed to be in saturation, the inductive elements 143 (L) are shown to be linear. For as long as voltage is maintained by the pulser 15, current will continue to flow through the termination load 144, as depicted by path 145. This parasitic quasi-dc current flow through the NLTL beam modulator 140 serves as a loss mechanism that reduces the overall efficiency of the system and may result in unwanted and potentially damaging heating of the components of the NLTL beam modulator 140.

Figure 10:
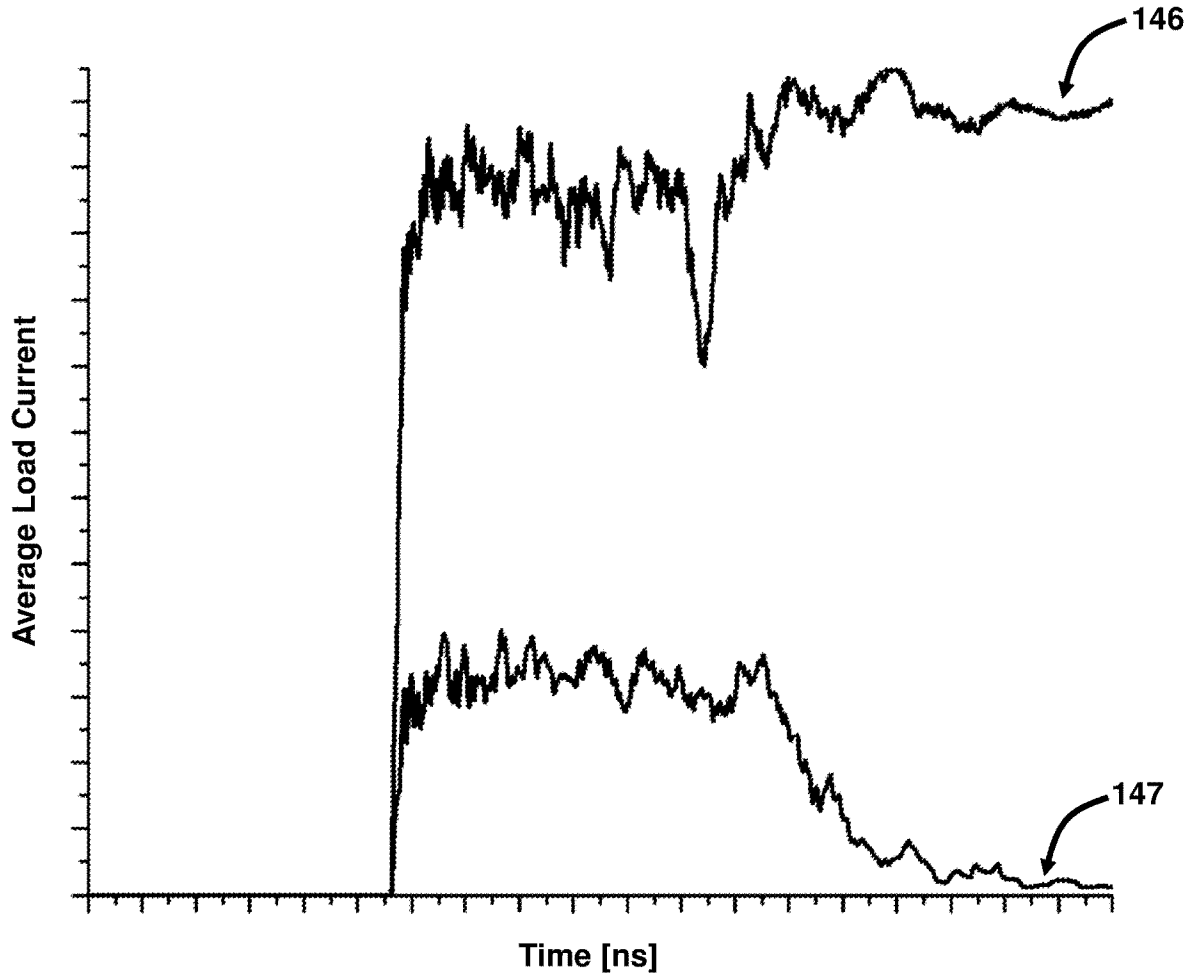
FIG. 10 is a graphical comparison plot of current through the termination load of a backward wave NLTL terminated with a fixed impedance load and a backward wave NLTL terminated with a MOV in series with a fixed impedance load, according to an embodiment herein.

The plot in FIG. 10, with reference to FIGS. 1A through 9, provides two traces of simulation data representing current flow 146 through the termination load 95 of the NLTL 25 without a MOV element (such as the circuit in FIG. 9) and current flow 147 when a MOV element is used (such as the circuit in FIG. 8G). As indicated by the trace for the current flow 147, for transmission lines having an MOV element 90 in series with the termination load 95, current will flow while the MOV terminal voltage is above the MOV threshold voltage 94 but will drop to zero as the MOV terminal voltage drops back down below the threshold voltage 94 and the MOV 90 returns to a non-conductive state. In the case where only the termination load resistor is used, represented by the trace for current flow 146, current will continue to flow through the termination load 95 for as long as voltage remains applied by the input pulser 15.

Figure 11:
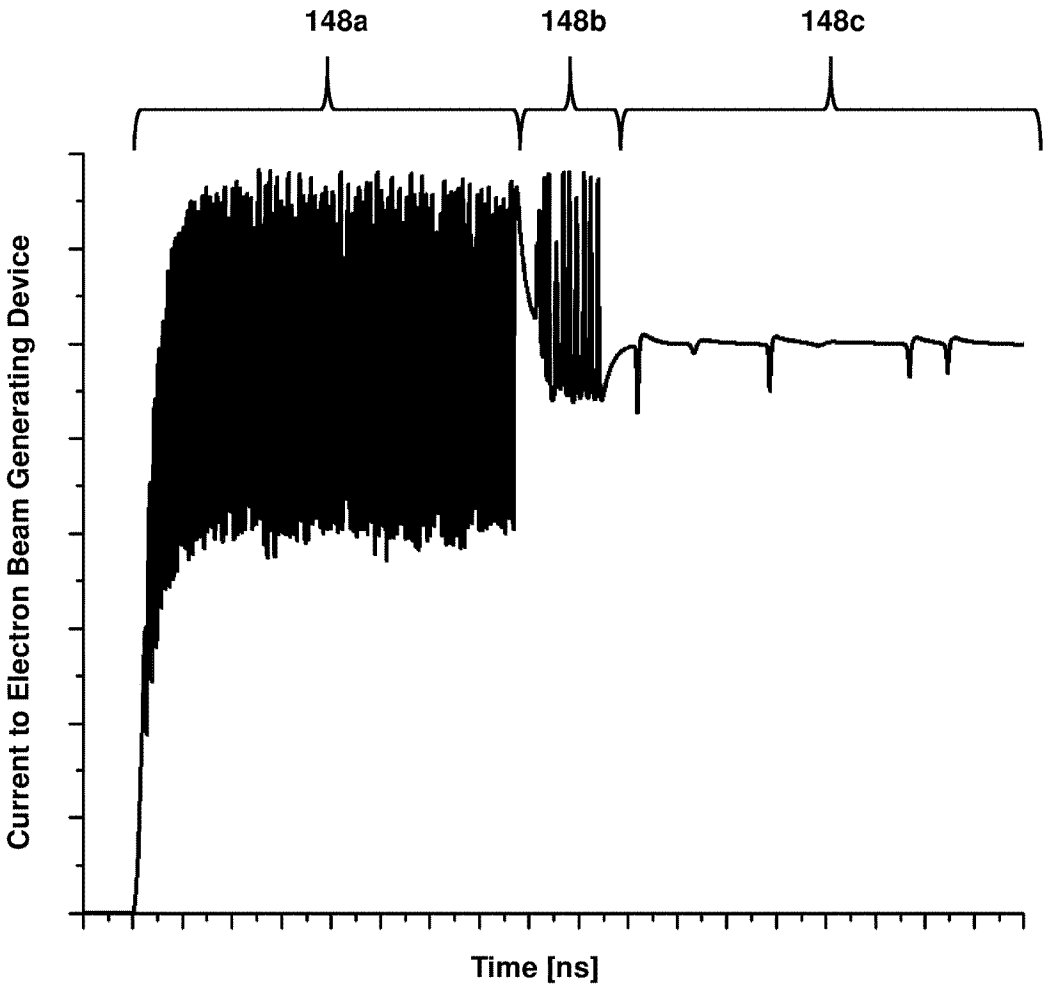
FIG. 11 is a graphical plot of current delivered to an electron beam emission device by an electron beam modulator based on a backward wave NLTL terminated by a MOV in series with a fixed impedance load, according to an embodiment herein.

FIG. 11, with reference to FIGS. 1A through 10, depicts a plot of simulation data showing current delivered to the electron beam generating device 40 for a beam driver configuration such as that shown in FIG. 4F wherein the NLTL 25 is terminated with a MOV-based termination component 65 (e.g., MOV 90 or Zener diode 92) such as shown in FIG. 8G. The backward wave NLTL 25 delivers a series of RF oscillations 30 superposed on the quasi-dc voltage imposed by the input pulser 15 as denoted in time period 148*a*. A small duration of reflection RF oscillations 30 as denoted in time period 148*b* are generated due to energy which is reflected from the input terminal of the MOV 90 while it is in the process of transitioning between non-conductive and conductive states, but stabilizes to a steady current value during time period 148*c*.

Figure 12:
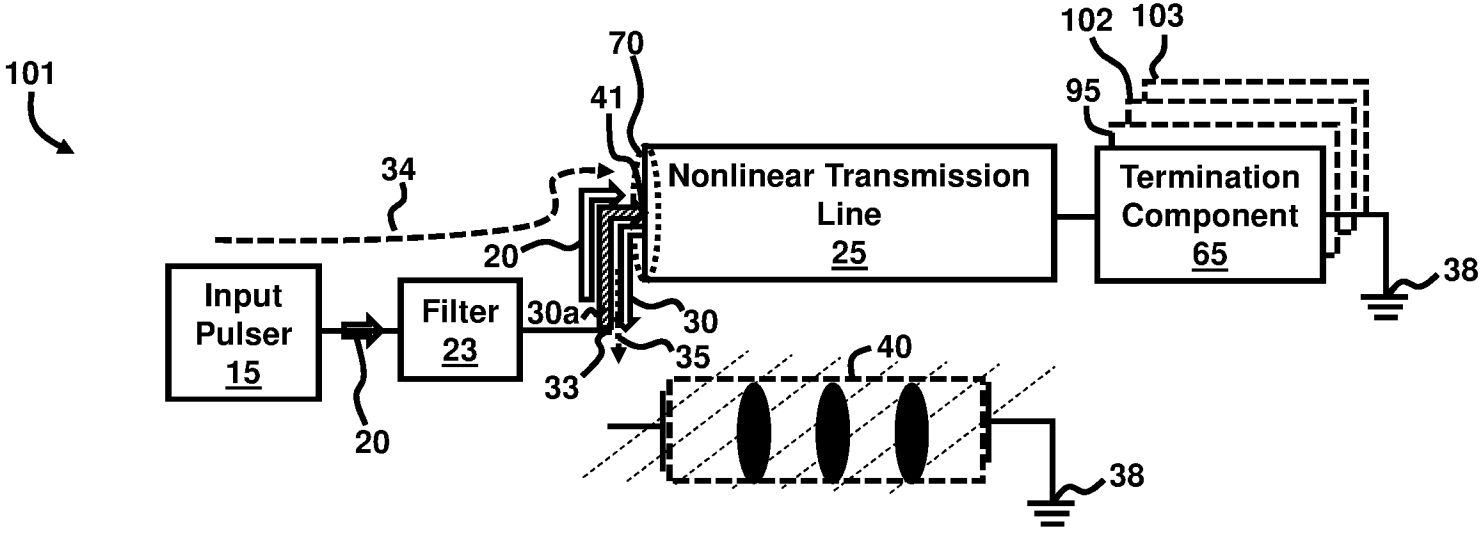
FIG. 12 is a block diagram illustrating another system for performing electron beam modulation using a backward NLTL, according to an embodiment herein.

FIG. 12, with reference to FIGS. 1A through 11, illustrates another embodiment herein that provides a system 101 comprising an input pulser 15 to generate an electromagnetic pulse 20 to travel in a first direction 34. The filter 23 controls the electromagnetic pulse 20. A backward wave NLTL 25 interacts with the electromagnetic pulse 20 to form a shock front 70, and generate a backward wave RF oscillation 30 to travel in a second direction 35 opposite that of the first direction 34. In system 101, the electron beam generating device 40 is electromagnetically disconnected from junction 33, or is simply not present, such that the RF oscillation 30 generated via the previously described backward wave interaction of the electromagnetic pulse 20 within the NLTL 25 exits the NLTL 25 via connection 41, travels toward the filter 23, where it is reflected back as RF oscillation 30*a* toward the NLTL 25. If the nonlinear elements of the NLTL 25, which are originally saturated after the passage of the leading edge of the electromagnetic pulse 20, remain in a saturated condition, the reflected backward wave RF oscillation 30*a* passes through the NLTL 25 and interacts with the termination component 65 to ground 38. The termination component 65 may be replaced with a termination load 95, an electron beam generating device 102 similar to electron beam generating device 40, or a radiating structure 103, such as an antenna. Because the RF oscillation 30 will have been generated through a backward wave interaction prior to being reflected back through the saturated NLTL 25, it will have the aforementioned beneficial properties of oscillations generated with backward devices, such as a longer RF pulse length and greater consistency of RF oscillations, compared to RF oscillations generated through a forward wave interaction.

Figure 13A:
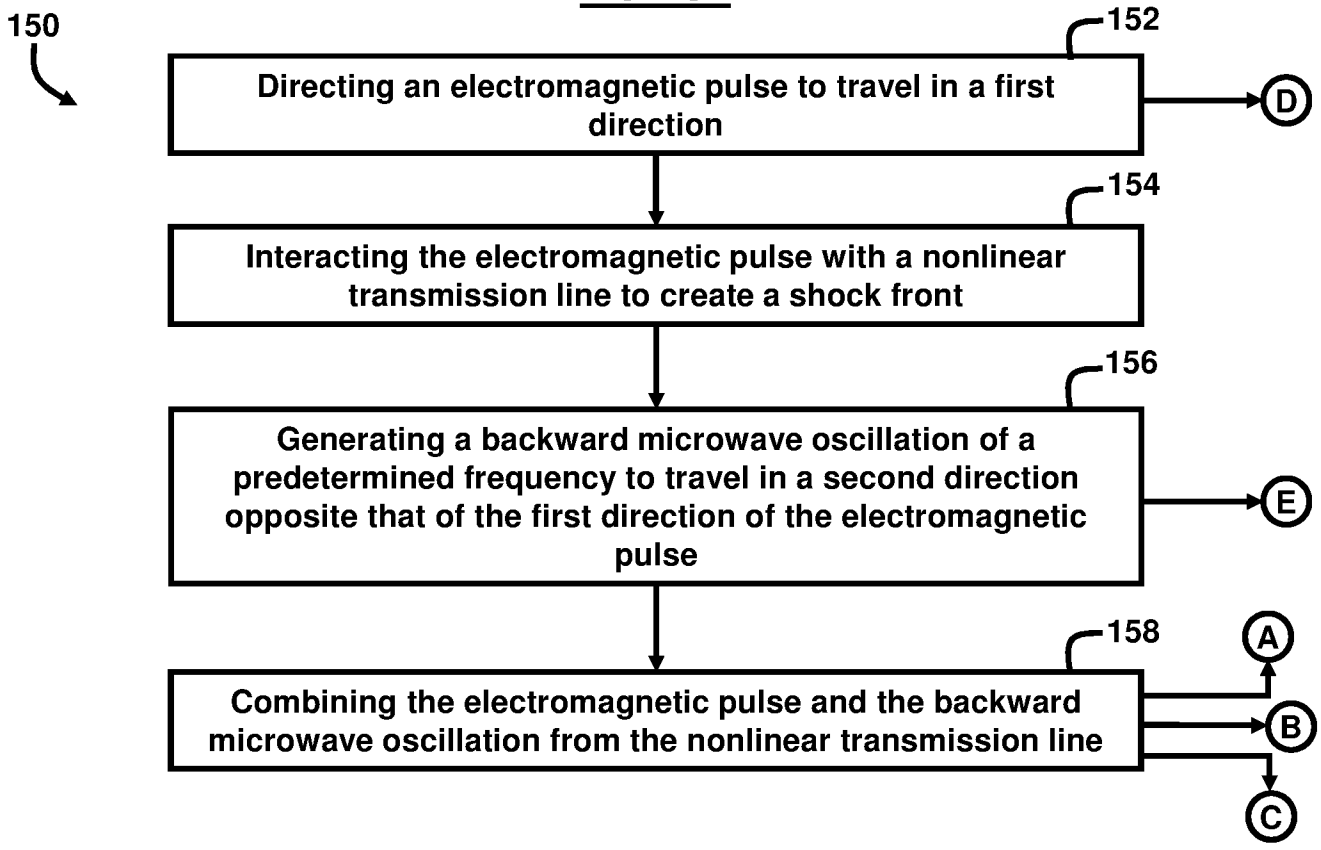
FIG. 13A is a flow diagram illustrating a method of performing electron beam modulation using a backward NLTL, according to an embodiment herein.

FIGS. 13A through 13F, with reference to FIGS. 1A through 12, are flow diagrams illustrating a method 150 according to an embodiment herein. As shown in FIG. 13A the method 150 comprises directing (152) an electromagnetic pulse 20 to travel in a first direction 34; interacting (154) the electromagnetic pulse 20 with a NLTL 25 to create a shock front 70; generating (156) a backward microwave oscillation (e.g., backward wave RF oscillation 30) of a predetermined frequency to travel in a second direction 35 opposite that of the first direction 34 of the electromagnetic pulse 20; and combining (158) the electromagnetic pulse 20 and the backward microwave oscillation (e.g., backward wave RF oscillation 30) from the NLTL 25.

Figure 13B:
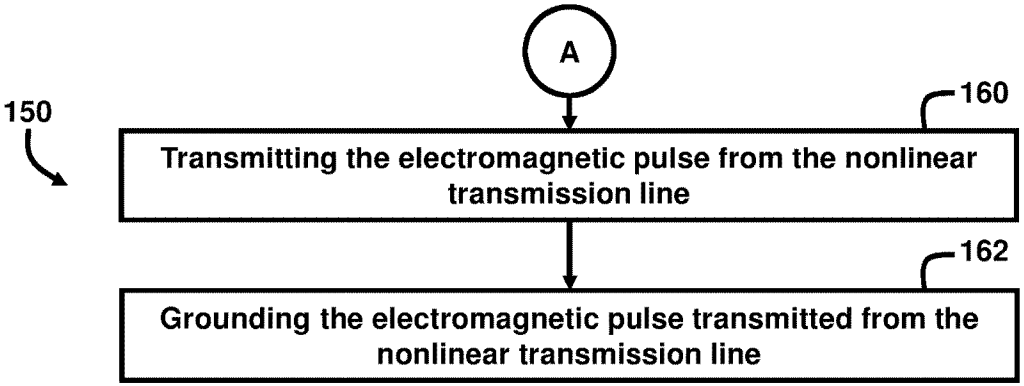
FIG. 13B is a flow diagram illustrating a method of transmitting and grounding an electromagnetic pulse in an electron beam modulation process, according to an embodiment herein.
Figure 13C:
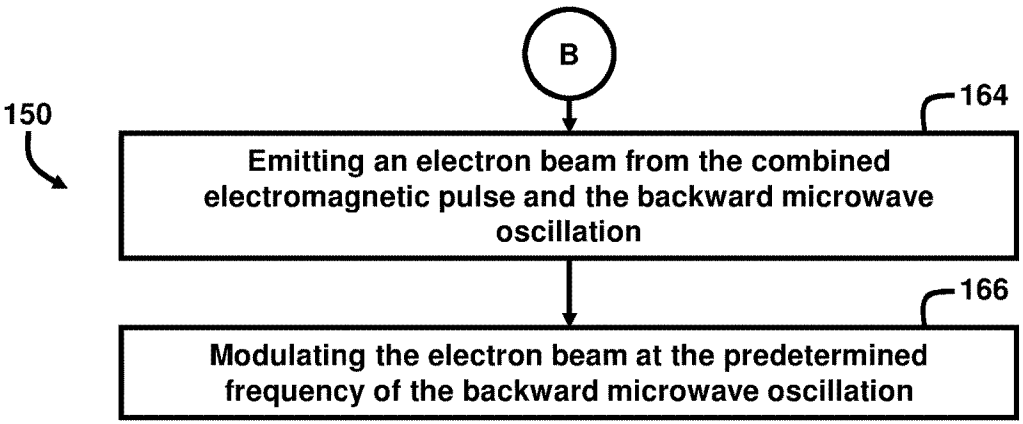
FIG. 13C is a flow diagram illustrating a method of emitting and modulating an electron beam in an electron beam modulation process, according to an embodiment herein.
Figure 13D:
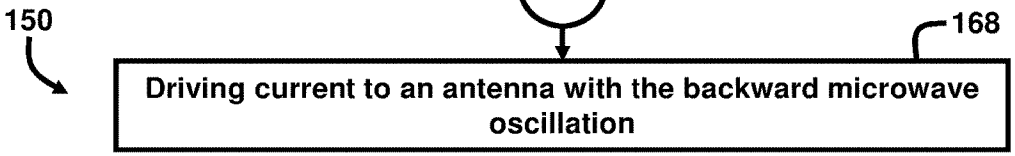
FIG. 13D is a flow diagram illustrating a method of driving current to an antenna in an electron beam modulation process, according to an embodiment herein.
Figure 13E:
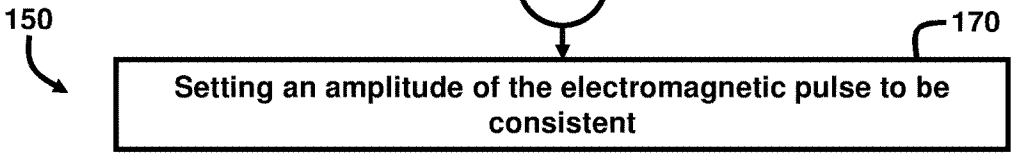
FIG. 13E is a flow diagram illustrating a method of setting an amplitude of an electromagnetic pulse in an electron beam modulation process, according to an embodiment herein.
Figure 13F:
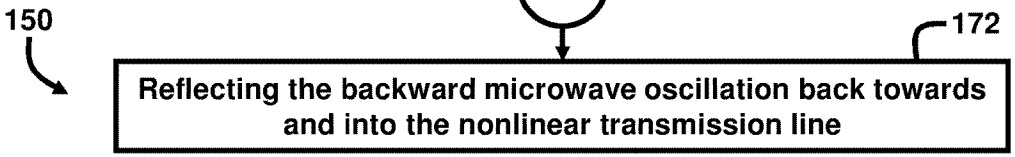
FIG. 13F is a flow diagram illustrating a method of reflecting the backward microwave oscillation back towards and into the nonlinear transmission line, according to an embodiment herein.

As shown in FIG. 13B, the method 150 may comprise transmitting (160) the electromagnetic pulse 20 from the NLTL 25, and grounding (162) the electromagnetic pulse 20 transmitted from the NLTL 25. As shown in FIG. 13C, the method 150 may comprise emitting (164) an electron beam 55 from the combined electromagnetic pulse 20 and the backward microwave oscillation (e.g., backward wave RF oscillation 30), and modulating (166) the electron beam 55 at the predetermined frequency of the backward microwave oscillation (e.g., backward wave RF oscillation 30). As shown in FIG. 13D, the method 150 may comprise driving (168) current to an antenna 80 with the backward microwave oscillation (e.g., backward wave RF oscillation 30). As shown in FIG. 13E, the method 150 may comprise setting (170) an amplitude of the electromagnetic pulse 20 to be consistent in order ensure that a uniform modulation voltage is applied. As shown in FIG. 13F, the method 150 may comprise reflecting (172) the backward microwave oscillation (e.g., reflected backward wave RF oscillation 30*a*) back towards and into the NLTL 25.

The bunched electron beam 55 has its main utility in producing RF. In high power vacuum tubes for RF production, the electron beam 55 interacts with the circuit of the apparatus 10 or system 100 and generates RF. In some cases, the bunching is achieved through electric fields provided by an external source (not shown). In other implementations, the electron beam 55 itself becomes unstable and breaks into bunches. The method 150 provides an additional way, whereby electrons are bunched directly during electron emission. One aspect of the method 150 is that initial bunching occurs in both velocity and current, which is unique to this class of device. In the alternate arrangement, the backward wave NLTL 25 with the termination component 65 may be used for an increased-efficiency RF driver for the antenna 80. The embodiments herein may be utilized in various application such as, for example, electron beam modulator devices, high power microwave tubes, priming devices, modulated x-ray beams, and directed energy applications.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Those skilled in the art will recognize that the embodiments herein can be practiced with modification within the spirit and scope of the appended claims.

What is claimed is:

1. An apparatus for performing electron beam modulation, the apparatus comprising:

an input pulser to provide an electromagnetic pulse;

a radio frequency (RF) filter to filter the electromagnetic pulse;

a nonlinear transmission line to receive the electromagnetic pulse, and generate a backward wave RF oscillation of a predetermined frequency to travel in a direction opposite that of the electromagnetic pulse; and an electron beam generating device comprising an anode and a cathode, the electron beam generating device to receive a combined electromagnetic pulse from the RF filter and the backward wave RF oscillation from the nonlinear transmission line to cause excitation of a modulated voltage between the anode and cathode, and to cause the electron beam generating device to emit an electron beam that is modulated at the predetermined frequency of the backward wave RF oscillation.

2. The apparatus of claim 1, wherein the nonlinear transmission line comprises any of a capacitor, inductor, and resistor, one or more of which have a nonlinear electromagnetic response.

3. The apparatus of claim 1, wherein any of the anode and the cathode receives the combined electromagnetic pulse and the backward wave RF oscillation.

4. The apparatus of claim 1, wherein the RF filter is to block the backward wave RF oscillation from interacting with a portion of the input pulser.

5. The apparatus of claim 1, wherein the input pulser contains the RF filter.

6. The apparatus of claim 1, wherein any of the anode and cathode are to emit the modulated electron beam.

7. The apparatus of claim 1, comprising a termination component to ground the electromagnetic pulse transmitted from the nonlinear transmission line.

8. A system comprising:

an input pulser to generate an electromagnetic pulse to travel in a first direction;

a filter to control the electromagnetic pulse;

a nonlinear transmission line to interact with the electromagnetic pulse to form a shock front, and generate a backward wave RF oscillation to travel in a second direction opposite that of the first direction;

a termination component to ground the electromagnetic pulse transmitted from the nonlinear transmission line; and a device to receive the electromagnetic pulse from the filter and the backward wave RF oscillation from the nonlinear transmission line.

9. The system of claim 8, wherein the device comprises an electron beam generating device to emit an electron beam that is modulated at a frequency of the backward wave RF oscillation.

10. The system of claim 9, wherein the electron beam generating device comprises an anode and a cathode, and wherein a polarity of the electromagnetic pulse determines whether the electromagnetic pulse enters the electron beam generating device through either the anode or cathode.

11. The system of claim 8, wherein the device comprises an antenna.

12. The system of claim 11, comprising a high pass filter between the nonlinear transmission line and the antenna.

13. The system of claim 8, wherein the termination component comprises any of a metal oxide varistor and a Zener diode, or an electromagnetically equivalent component, in series with a termination load of the nonlinear transmission line.

14. The system of claim 13, wherein the metal oxide varistor or an electromagnetically equivalent component is set to conduct at a voltage level of approximately a peak value of the input pulser.

15. A method comprising:

directing an electromagnetic pulse to travel in a first direction;

interacting the electromagnetic pulse with a nonlinear transmission line to create a shock front;

generating a backward microwave oscillation of a predetermined frequency to travel in a second direction opposite that of the first direction of the electromagnetic pulse; and combining the electromagnetic pulse and the backward microwave oscillation from the nonlinear transmission line.

16. The method of claim 15, comprising:

transmitting the electromagnetic pulse from the nonlinear transmission line; and grounding the electromagnetic pulse transmitted from the nonlinear transmission line.

17. The method of claim 15, comprising:

emitting an electron beam from the combined electromagnetic pulse and the backward microwave oscillation; and modulating the electron beam at the predetermined frequency of the backward microwave oscillation.

18. The method of claim 15, comprising driving current to an antenna with the backward microwave oscillation.

19. The method of claim 15, comprising setting an amplitude of the electromagnetic pulse to be consistent.

20. The method of claim 15, comprising reflecting the backward microwave oscillation back towards and into the nonlinear transmission line.

* * * * *